US007117617B2

(12) United States Patent
Kost et al.

(10) Patent No.: US 7,117,617 B2
(45) Date of Patent: Oct. 10, 2006

(54) SNOWPLOW MOUNT

(75) Inventors: James A. Kost, Willoughby, OH (US); Robert L. Potak, Strongsville, OH (US)

(73) Assignee: The Louis Berkman Company, Steuberville, OH (US)

( * ) Notice: Subject to any disclaimer, the term of this patent is extended or adjusted under 35 U.S.C. 154(b) by 0 days.

(21) Appl. No.: 10/607,906

(22) Filed: Jun. 27, 2003

(65) Prior Publication Data

US 2004/0088892 A1 May 13, 2004

Related U.S. Application Data

(63) Continuation of application No. 10/083,435, filed on Feb. 27, 2002, now Pat. No. 6,618,964, which is a continuation of application No. 09/449,945, filed on Nov. 29, 1999, now Pat. No. 6,354,024.

(51) Int. Cl.
*E01H 5/04* (2006.01)

(52) U.S. Cl. ..... 37/231; 37/236; 37/270; 172/273

(58) Field of Classification Search ..... 37/234–236, 37/231, 264, 266, 270; 172/273, 272, 277, 172/814, 819, 810, 811, 817, 245, 253, 275
See application file for complete search history.

(56) References Cited

U.S. PATENT DOCUMENTS

| | | | |
|---|---|---|---|
| 1,692,750 | A | 11/1928 | Marran |
| 1,900,703 | A | 3/1933 | Frink |
| 1,925,397 | A | 9/1933 | Meyer |
| 1,926,011 | A | 9/1933 | Soule |
| 2,160,973 | A | 6/1939 | Litchy |
| 2,498,470 | A | 2/1950 | Wenner |
| 2,667,708 | A | 2/1954 | Gjesdahl |
| 2,904,904 | A | 9/1959 | Krueger |
| 3,104,893 | A | 9/1963 | Torrey |
| 3,214,138 | A | 10/1965 | Jocher et al. |
| 3,252,716 | A | 5/1966 | Gaterman |
| 3,353,287 | A | 11/1967 | King |
| 3,400,475 | A | 9/1968 | Peitl |
| 3,410,008 | A | 11/1968 | Standfuss |
| 3,429,059 | A | 2/1969 | Reissinger |
| 3,432,946 | A | 3/1969 | Peitl |
| 3,432,947 | A | 3/1969 | Peitl |
| 3,456,369 | A | 7/1969 | Leposky |
| 3,650,054 | A | 3/1972 | Hanson |
| 3,706,144 | A | 12/1972 | Miceli |
| 3,749,180 | A | 7/1973 | Coontz |
| 3,793,752 | A | 2/1974 | Snyder |
| 3,800,882 | A | 4/1974 | Werts et al. |
| 3,815,687 | A | 6/1974 | Federspiel |
| 3,828,449 | A | 8/1974 | Miceli |
| 3,987,562 | A | 10/1976 | Deen et al. |
| 4,236,329 | A | 12/1980 | Hetrick |
| 4,238,895 | A | 12/1980 | Hetrick |
| 4,259,794 | A | 4/1981 | Rath |

(Continued)

*Primary Examiner*—Victor Batson
(74) *Attorney, Agent, or Firm*—Brouse McDowell; Roger D. Emerson; Timothy D. Bennett

(57) ABSTRACT

A snowplow blade mount assembly mountable on a vehicle that includes a frame mount assembly which is affixed to a frame of the vehicle and a support assembly that connects to the frame mount assembly. The support assembly is designed to connect to a lift mount assembly and a blade mount assembly. The support assembly enables the blade mount assembly and/or lift mount assembly to be conveniently connected and disconnected from the vehicle.

45 Claims, 17 Drawing Sheets

U.S. PATENT DOCUMENTS

| | | | | |
|---|---|---|---|---|
| 4,279,084 | A | 7/1981 | Low et al. | |
| 4,342,163 | A | 8/1982 | Hoekstra | |
| 4,459,769 | A | 7/1984 | Willis, Sr. | |
| 4,528,762 | A | 7/1985 | Sarka et al. | |
| 4,574,502 | A | 3/1986 | Blau | |
| 4,803,790 | A | 2/1989 | Ciula | |
| 4,845,866 | A | 7/1989 | Ciula | |
| 4,976,054 | A | 12/1990 | Jones | |
| 5,036,608 | A | 8/1991 | Ciula | |
| 5,075,985 | A | 12/1991 | Mensch | |
| 5,075,988 | A | 12/1991 | Ciula | |
| 5,088,215 | A | 2/1992 | Ciula | |
| 5,094,109 | A | 3/1992 | Dean et al. | |
| 5,125,174 | A | 6/1992 | Watson et al. | |
| 5,185,946 | A | 2/1993 | Farrell | |
| 5,193,296 | A | 3/1993 | Reilley | |
| 5,309,653 | A | 5/1994 | Pease et al. | |
| 5,353,530 | A | 10/1994 | Pieper | |
| 5,437,113 | A | 8/1995 | Jones | |
| 5,638,617 | A | 7/1997 | Bélanger et al. | |
| RE35,700 | E | 12/1997 | Watson et al. | |
| 5,729,919 | A | 3/1998 | DeBoer | |
| 5,806,214 | A | 9/1998 | Behrens et al. | |
| 5,832,637 | A | 11/1998 | Aguado et al. | |
| 5,870,839 | A | 2/1999 | Wissmiller | |
| 5,894,688 | A | 4/1999 | Struck et al. | |
| 5,899,007 | A | 5/1999 | Niemela et al. | |
| 6,012,240 | A * | 1/2000 | Klug et al. | 37/231 |
| 6,050,008 | A | 4/2000 | Doornek et al. | |
| 6,073,371 | A | 6/2000 | Goos et al. | |
| 6,102,131 | A | 8/2000 | Malinowski | |
| 6,138,388 | A | 10/2000 | Kost et al. | |
| 6,145,222 | A | 11/2000 | Curtis | |
| 6,151,808 | A | 11/2000 | Curtis | |
| 6,163,985 | A | 12/2000 | Chinnery et al. | |
| 6,170,178 | B1 | 1/2001 | Christy | |
| 6,178,669 | B1 | 1/2001 | Quenzi et al. | |
| 6,209,231 | B1 * | 4/2001 | Curtis | 37/231 |
| 6,240,659 | B1 * | 6/2001 | Curtis et al. | 37/236 |
| 6,276,075 | B1 | 8/2001 | Kost et al. | |
| 6,276,076 | B1 | 8/2001 | Quenzi et al. | |
| 6,354,024 | B1 * | 3/2002 | Kost et al. | 37/231 |
| 6,363,629 | B1 * | 4/2002 | Curtis | 37/231 |
| 6,381,880 | B1 * | 5/2002 | Curtis | 37/231 |
| 6,393,737 | B1 * | 5/2002 | Quenzi et al. | 37/231 |
| 6,408,546 | B1 * | 6/2002 | Curtis | 37/231 |
| 6,526,677 | B1 * | 3/2003 | Bloxdorf et al. | 37/231 |
| 6,557,275 | B1 * | 5/2003 | Curtis | 37/231 |
| 6,564,479 | B1 * | 5/2003 | Vickers | 37/233 |
| 6,618,965 | B1 * | 9/2003 | Schultz et al. | 37/232 |

* cited by examiner

SNOWPLOW MOUNT

This patent application is a continuation of application Ser. No. 10/083,435 filed on Feb. 27, 2002, now U.S. Pat. No. 6,618,694 which in turn is a continuation of application Ser. No. 09/449,945 filed on Nov. 29, 1999, now U.S. Pat. No. 6,354,024, and which are incorporated herein by reference.

This invention relates primarily to plows and more particularly to an improvement in snowplows mountable on a motor vehicle for removing snow and other debris from road ways and similar surfaces.

The invention is particularly applicable to a snowplow apparatus and construction, wherein an improved snowplow mount assembly is provided for attaching and detaching the snowplow from the vehicle and will be described with particular reference thereto.

INCORPORATION BY REFERENCE

Assignee's U.S. Pat. Nos. 3,828,449; 4,236,329; 4,279,084; 5,036,608; and 5,075,988 and are incorporated by reference herein so as to detail prior snow blade mounting devices known in the art. Assignee's U.S. Pat. Nos. 3,353,287; 3,365,456; 3,432,947; 3,650,054; 3,706,144; 4,528,762; 4,803,790; 4,845,866; and 5,088,215; and co-pending U.S. patent application Ser. No. 09/215,812 filed Dec. 18, 1998 are also incorporated herein by reference to illustrate various snowplow blade designs and snowplow blade support units.

BACKGROUND OF THE INVENTION

It is common for owners of vehicles to equip the vehicle with a snowplow for the purpose of removing snow from a ground surface. These vehicles include cars, jeeps, sport utility vehicles, pick-ups and the like. Each type of vehicle has a different frame structure and a different bumper design to accommodate the frame structure. At present, the most commonly used arrangement for attaching a snowplow blade to a vehicle involves pivotally connecting an A-frame which supports the blade to a frame extension below the front of the vehicle. Vertical displacement of the snowplow blade in the A-frame is provided by a lift-mount assembly. The lift-mount assembly serves primarily to raise, lower and support the plow blade, such as by raising the plow blade above the ground during transportation of the snowplow blade as well as during a snowplow operation. The lift-mount assembly typically includes a hydraulic cylinder, lift arm and chain or cable arrangement mounted above the vehicle frame. Typically, the A-frame is aligned with the vehicle frame below the front of the vehicle to provide proper blade alignment.

The A-frame generally includes a frame assembly supporting a plow blade forwardly of the vehicle and having an inner end design to be releasably hitched to the support structure beneath the vehicle. Detachment of the snowplow blade unit from the vehicle enables use of the vehicle for personal and/or work oriented purposes other than snowplowing.

Depending on the type of the frame mount used, the frame mount typically projects out beyond or coplanar with the bumper thereby defeating the purpose of the bumper. In addition, the frame mount becomes a potentially dangerous battering ramp when extended past the bumper, and is subject to being damaged itself in a collision. Such prior art lift assemblies are disclosed in U.S. Pat. Nos. 2,667,708; 3,214,138; 3,410,008; 3,456,369; and 3,987,562. In addition, these prior art mount assemblies include one or more of a number of structural disadvantages, such as a) excessive weight, b) exposure to adverse environmental conditions, c) potential physical damage during non-snowplowing use, d) high cost of manufacture, e) difficulty in mounting to a variety of vehicle frames, and f) undesirable aesthetics when used on a vehicle. More particularly, with regard to such disadvantages, these prior art lift mount assemblies are typically 1) mounted on the existing vehicle bumper or on a special cross member between the vehicle frame members which either replaces or is provided in addition to the bumper, or 2) are mounted on one of the vehicle's frame and bumper components and interconnected with the one another. Furthermore, due to the design of these prior art mounting systems, when the snow blade is elevated, the lift arm mounting members cause considerable stress at the point of connection between the mounting members and the vehicle as a result of the weight of the corresponding snowplow blade unit. Such forces necessitate structurally heavy mounting members and supports, and special structural interconnections there between in an effort to minimize damage and/or bending or breakage of the mounting members and/or support components. This results in undue weight to the support unit and increased complexity in the assembly and the repair of the support unit. The lift arm assemblies are also intended to remain on the vehicle when the snowplow unit is removed therefrom. This is undesirable from the stand point of the weight imposed on the front axle of the vehicle and can result in a violation of one or more governmental restrictions with respect to vehicle loading. In addition, one or more of the lift components project a considerable distance forward of the vehicle bumper thus exposing such components to damage or destruction should the vehicle impact against an object. Moreover, these components, when exposed to the elements year round, can begin to deteriorate, therefore requiring more frequent maintenance, repair and replacing, thus increasing the expense of using such an assembly. The permanent fixture of these components to the vehicle also can significantly deteriorate from the aesthetic appearance of the front of the vehicle during non-winter months.

Many efforts have been made to resolve several of these problems with respect to the use of snowplow blades. Assignees' U.S. Pat. No. 4,279,084 improves on a number of draw backs of prior art lift mount assemblies. This lift mount assembly reduces the number of modifications to the front end of the vehicle to accommodate the lift mount assembly. This lift mount assembly replaces projecting parts of the lift mount assembly with somewhat recessed exposed parts which do not bear the full impact of a collision should the vehicle impact against an object during non-snowplow use. However, the foremost part of the bracket portion of the lift mount assembly is located on the same vehicle plane as the foremost part of the bumper. Therefore, both the bumper and the lift mount bear the brunt of any collision. Potential damage to the lift mount assembly remains a likelihood on the collision. The lift mount assembly also must be positioned behind the bumper which can present installation problems. The mount assembly also requires some rigging to establish the top mounting point behind the bumper which can be troublesome for some vehicles.

Assignees' U.S. Pat. No. 5,036,608 improved on many of the remaining drawbacks of existing mount assemblies. The mount assembly is a two piece assembly wherein the housing unit is affixed to the frame of the vehicle beneath and behind the bumper of the vehicle thereby eliminating parts of the housing from being damaged on collision by the vehicle. The lift mount assembly also includes a support unit which releasably attaches to the housing and is designed to support components of the mount assembly to lift and lower the snowplow frame assembly. When the snowplow blade and A-frame are removed from the housing unit, the support unit may also be removed thereby eliminating projecting parts of the lift mount assembly from being exposed to damage. The removal of these components also enhances the authentic appearance of the vehicle during non-winter months and prevents the lift mount assembly components from being exposed to the elements throughout the year.

Although U.S. Pat. No. 5,036,608 is a significant improvement over prior art lift mount assemblies, the improved lift mount assembly does not address several problems with respect to the mounting of the lift assembly and blade mount assembly to various types of vehicles, the adjustment of the lift assembly to various types of vehicles, and the difficulty in attaching and detaching the lift assembly and/or snow blade mount assembly from the vehicle.

SUMMARY OF THE INVENTION

The present invention contemplates a new and improved snowplow mount assembly for attaching a snowplow blade unit to a vehicle which overcomes all of the above referenced problems and enables a lift mount assembly and/or a plow mount assembly to be quickly released from the vehicle. In this respect, the snowplow mount assembly, according to the present invention, is structurally simple and light in weight, thus enabling a savings in cost while facilitating the installation procedure and reducing the weight imposed on the front axle of the vehicle during snowplowing and non-snowplowing use. The snowplow mount assembly is structurally independent of the vehicle bumper and is mountable on a vehicle without replacing the original or existing bumper. The snowplow mount assembly advantageously enables quick release and removal of the support assembly from the supporting portion of a frame mount assembly, whereby only the frame mount assembly need remain on the vehicle during non-snowplowing use of the vehicle. Accordingly, components of the support assembly and components attached thereto can be stored and thus protected from adverse environmental conditions and potential damage by impact of the vehicle with another object during non-snowplowing use thereof. The snowplow mount assembly is constructed in association with the vehicle so as to advantageously minimize both the visibility of the frame mount assembly and the projection of the parts of the frame mount assembly thereof forwardly of the vehicle when the support assembly is removed, thus promoting the aesthetic appearance of the front of the vehicle. The mounting of the frame mount assembly independent of the vehicle's bumper allows forces and stresses imposed on the frame mount assembly when the snowplow blade is elevated to be transmitted through the frame mount assembly to the vehicle frame, thus avoiding any distortion of the bumper member and/or any disfiguring thereof by attachment of the component parts of the assembly thereto.

In accordance with another aspect of the present invention, a snowplow mount assembly includes four principal components, namely a frame mount assembly, a support assembly, a lift mount assembly, and a plow mount assembly. The frame mount assembly is affixed to the frame of the vehicle and has at least one attachment point situated beneath and behind the bumper of the vehicle. The support assembly is designed to be connected to the at least one attachment point on the frame mount assembly. The support assembly is also design to be connected to the lift mount assembly and/or the plow mount assembly. The support assembly thereby integrates the lift mount assembly and/or plow mount assembly with the frame mount assembly. The support assembly is mounted to the frame mount assembly in a manner to allow the support assembly to be releasably attached to the frame mount assembly for easy removal from the vehicle. In one embodiment, the removal of the support assembly from the frame mount assembly results in no permanent structures of the snowplow mount protruding beyond the vehicle bumper.

In accordance with still another aspect of the present invention, the lift mount is designed to be detachable from or permanently affixed to the support assembly. In one embodiment, the lift mount assembly includes a lift arm that is connected or interconnected to the plow mount assembly for lifting and lowering the plow mount assembly.

In accordance with yet another aspect of the present invention, the plow mount assembly is designed to be detachable from or permanently affixed to the support assembly. In one embodiment, the plow mount assembly includes an A-frame design to support a snowplow blade.

In accordance with still another aspect of the present invention, the frame mount assembly is design to include a connection section that facilitates in the attachment of the support assembly to the frame mount assembly. The connection section can also function as a structural support for the other components of the frame mount assembly and to help rigidify and strengthen such components. The connection section facilitates in the dismounting of the support assembly from the frame mount assembly. In one embodiment, the frame mount assembly includes one or more regions that at least partially assist in guiding at least a portion of the support assembly into proper orientation with the frame mount assembly so that the support assembly can be mounted to the frame mount assembly. In one specific embodiment, the frame mount assembly the connection section includes a leg extension angularly oriented in the frame mount assembly. In this specific embodiment, the leg extension preferably slopes upwardly toward the bumper of the vehicle. Furthermore, in this specific embodiment, the leg extension is preferably angularly oriented to a ground surface at an angle between about 0 and 45°, and preferably between about 15 and 30°. In another specific embodiment, the frame mount assembly includes a landing designed to receive a portion of the support assembly. In this specific embodiment, the landing is designed to have a shape such that a portion of the support assembly inserts into the landing to thereby insure the proper positioning and the proper attachment of the support assembly to the frame mount assembly. Furthermore, in this specific embodiment, the landing of the frame mount assembly preferably includes one or more angular lip sections designed to facilitate in the insertion of the support assembly in the frame mount assembly. In addition, in this specific embodiment, the bottom portion of the landing preferably includes an angular lip having a downward angular deflection between about 0 and 15° so as to facilitate the guiding of the portion of the support assembly into the landing of the frame mount assembly. As can be appreciated, the angular deflection of the lip may be some other angle and the landing may include other angular lip sections to help facilitate in the insertion of the support assembly in the frame mount assembly. In another specific embodiment, the frame mount assembly includes one or more sloped surfaces that guide a portion of the support assembly to a location in the frame mount assembly where the support assembly is mounted to the frame mount assembly.

In accordance with still yet another aspect of the present invention, there is provided a support assembly which includes an end leg member that is design to mount with the frame mount assembly. The end leg portion is designed to have a dimension so as to fit into a specific region of the frame mount assembly. In one embodiment, the end leg member is angularly displaced with respect to a mid-body section of the support assembly. In another embodiment, the end leg member includes one or more angular surfaces which facilitate in the positioning of the end leg member in a desired location of the frame mount assembly. In still another embodiment, at least a portion of the cross-sectional shape of the end leg member is substantially similar to at least a portion of the cross-sectional shape of the frame mount assembly such that at least a portion of the outer surfaces of the end leg member forms a complimentary surface with the interior surfaces of the frame mount assembly when the support assembly is properly inserted into and connected to the frame mount assembly. In a further embodiment, the end leg member includes a positioning flange that facilitates in the positioning of the end leg portion in the desire position of the frame mount assembly. In one specific embodiment, the positioning flange is secure at or near the bottom of the end leg portion and is designed to contact a surface of the frame mount assembly to at least partially restrict the movement of the end leg portion when positioning the end leg portion in the frame mount assembly for mounting purposes. In another specific embodiment, the positioning flange facilitates in orienting the support assembly vertically and/or laterally in the frame mount assembly as the support assembly is positioned in the frame mount assembly. In yet another specific embodiment, the positioning flange is secure at or near the top of the end leg portion and is designed to contact a surface of the frame mount assembly to at least partially restrict the movement of the end leg portion when positioning the end leg portion in the frame mount assembly for mounting purposes. In still another specific embodiment, the positioning flange includes an angularly oriented lip which facilitates in the positioning and mounting of the end leg member to the frame mount assembly. In this specific embodiment, the lip has an angular deflection between about 0 and 70°.

In accordance with still a further aspect of the present invention, the support assembly includes a mid-section. The mid section of the support assembly is designed such that a portion of the outer surface of the mid-section forms a complimentary surface with the frame mount assembly when the support assembly is connected to the frame mount assembly. In one specific embodiment, the mid-section of the support assembly is designed to be connected to the frame mount assembly. In another specific embodiment, the mid-section of the support assembly includes an opening to receive a connector to secure the support assembly to the frame mount assembly. In this specific embodiment, the frame mount assembly includes an opening which forms a complimentary opening with the opening in the mid-section of the support assembly for the connector to be inserted there through when the support assembly is properly positioned in the frame mount assembly. In another specific embodiment, the support assembly is secured to the frame mount assembly in at least two locations, one at the leg portion and the other at the mid-section of the support assembly.

In accordance with another aspect of the present invention, the support assembly includes one or more connectors to enable the support assembly to be easily removed and/or attached to the frame mount assembly. In one embodiment the connector is a pin assembly, bolt assembly, latch assembly, and/or clamp assembly that secures the support assembly to the frame mount assembly. In one specific embodiment, the connector is a pin assembly and/or bolt assembly that is fitted into a hole in the frame mount assembly and through a hole in the support assembly which is aligned with the hole in the frame mount assembly when the support assembly is properly positioned in the frame mount assembly. In another specific embodiment, the connector is a pin assembly and/or bolt assembly that includes a locking and/or position mechanism to lock and/or secure the pin assembly and/or bolt assembly is a certain position during the mounting and/or dismounting of the support assembly to the frame mount assembly. In still another specific embodiment, the connector is a pin assembly and/or bolt assembly that includes a biasing mechanism to bias the pin and/or bolt in a certain position. Preferably, the biasing mechanism biases the pin and/or bolt in a attachment position to assist in maintaining that the support system remains mounted to the frame mount assembly after the support system has been mounted to the frame mount assembly. In one arrangement, the biasing mechanism includes a spring.

In another embodiment of the present invention, the support assembly includes a blade mount connector designed to connect the plow mount assembly to the support assembly. In one embodiment, the plow mount assembly is connected to the support assembly to allow at least a portion of the plow mount assembly to be lifted and/or lowered. In one specific embodiment, the plow mount assembly includes an opening which forms a complimentary opening with an opening in the support assembly for a connector to be inserted therethrough when the plow mount assembly is properly positioned with respect to the support assembly. In this specific embodiment, the plow mount assembly preferably can pivot about the connector. In still another embodiment, the plow mount assembly can be attached and/or detached from the support assembly. In one specific embodiment, the plow mount assembly is connected to the support assembly at a different location on the support assembly from the location the support system is connected to the frame mount assembly.

In accordance with still another aspect of the present invention, the support assembly includes at least one stop plate. The stop plate is designed to engage a portion of the blade mount assembly when the plow mount assembly is lifted into an upward position by the lift mount assembly and/or when the support assembly is disengaged from the frame mount assembly and lies upon the plow mount assembly. In one embodiment, the stop plate is positioned on the support assembly such that the stop plate and a top surface of the plow mount assembly form a complimentary surface with respect to one another when the portion of the plow mount assembly engages the stop plate. In another embodiment, the stop plate adds structural integrity to the support assembly to increase the rigidity to the support assembly and to inhibit deformation of the support assembly. In still another embodiment, the stop plate includes an adjustable extension to adjust the extension of a portion of the stop plate. In yet anther embodiment, the stop plate and/or blade mount adjustment includes a contact seat. In one specific embodiment, the contact seat includes metal, plastic, and/or rubber.

In accordance with a further aspect of the present invention, the support assembly includes a bumper plate to limit the amount of the support assembly that extends under the vehicle. The bumper plate helps to prevent damage to the support assembly and other components of the snowplow mount assembly. In one embodiment, the bumper plate is designed to engage a portion of the frame mount assembly to limit the position of the support assembly with respect to the frame mount assembly when mounting the support assembly to the frame mount assembly.

In accordance with still yet another aspect of the present invention, the support assembly includes a second end leg member that is designed to connect the lift mount assembly to the support assembly. In one embodiment, the second end leg member is rigidly connected to a portion of the lift mount assembly. The rigid connection can be formed by a weld, bolt, pin, clamp and the like. In another embodiment, a portion of the lift mount assembly is formed from a common portion of the support assembly. In still another embodiment, the lift mount assembly is angularly connected relative to the second end leg member. In this embodiment, the plow mount assembly is angularly oriented on the support assembly to reduce stress on the connection between the support assembly and the lift mount assembly. In still yet another embodiment, the lift mount assembly is connected to the support assembly to allow the lift mount assembly to be angularly adjustably connected to the support assembly. In this embodiment, adjustable connection enables the lift mount assembly to be used with a variety of different vehicles. In one specific embodiment, the adjustable connection can be formed by a tooth and groove arrangement, a pin arrangement, a bolting arrangement, a latch arrangement, or the like.

In accordance with still yet another aspect of the present invention, the lift mount assembly includes a plow blade stop designed to receive a portion of the plow blade when the plow blade is in the lifted position and/or when the support assembly is detached from the frame mount assembly and resting on the plow mount assembly. In one embodiment, the stop provides a resting surface for the plow blade and/or can be designed to assist in mounting the lift mount assembly and support assembly to and/or from the frame mount assembly. In another embodiment, the stop plate is designed to provide structural support and add rigidity to the lift mount assembly.

In accordance with still yet another aspect of the present invention, the lift mount assembly includes an adjustable lift arm. The height of the lift arm can be adjusted so as to accommodate a variety of different vehicles and/or increase the efficiency and operation of the lift mount assembly. In one embodiment, a plurality of connection locations are positioned on the legs of the lift mount assembly. The connection locations are designed to allow the lift arm to be attached at various height locations on the legs of the lift mount assembly. In one specific embodiment, connection locations include at least one opening whereby a bolt, pin or the like can be inserted there through to secure the lift arm to the legs. In still another embodiment, the lift arm is connect the lift arm in a singular angular orientation with respect to the legs. In a further embodiment, the lift arm is connect the lift arm to enable a plurality of angular orientations with respect to the legs.

In accordance with still yet another aspect of the present invention, the plow mount assembly includes a support mechanism to elevate at least a portion of the plow mount assembly above a ground surface when the plow mount assembly is detached from the support assembly and/or the support assembly is detached from the frame mount assembly. The support leg enables an operator to conveniently attach and/or reattach the end of the blade mount assembly to the support assembly, and/or helps to prevent damage to the support assembly and/or the plow mount assembly during the connecting and/or reconnecting of the plow mount assembly to the support assembly. In one embodiment, the support leg is movable between a support position and a non-support position. In the non-support position, the leg is raised and/or repositioned so as not to contact the ground surface during use of the snowplow blade. In the support position, the leg is lowered and/or repositioned so as to rest on the surface of the ground. In another embodiment, the support leg elevates one end of the plow mount assembly so that the plow mount assembly can be easily connected to and/or disconnected from the support assembly, and/or the support assembly can be easily connected to and/or disconnected from the frame mount assembly. In still another embodiment, the support leg is adjustably positionable to vary the elevation of the end of the plow mount assembly from the ground surface. The variable height positioning of the support leg can be accomplished in a variety of manners. In one specific embodiment, the support leg includes a plurality of openings whereby a bolt, pin or the like is positioned through the opening and secured in a portion of the blade mount assembly. The plurality of openings allow the support leg to support the end of the plow mount assembly in a variety of elevations above the ground. In another specific embodiment, the plurality of openings enables the support leg to be secured in a retracted position in multiple locations on the plow mount assembly. In another specific embodiment, the support leg is extended and/or retracted from the ground surface by a crank arrangement. In this embodiment, a crank is rotated to lower or raise the leg. Many arrangements which include the crank can be used to raise and lower the support leg. These arrangements can include rope, cord, chains, screw, teeth and/or grooves. In one preferred arrangement, the leg includes a plurality of grooves that engage rotating teeth which are rotated by the crank. In another preferred arrangement, the leg is raised and lowered by a screw-jack arrangement. In another embodiment, the support leg includes a mount flange that enables the support leg to be attached and detached from the plow mount assembly. In still another embodiment, the support leg can be stored on the lift mount assembly or support assembly when not in use. In a further embodiment, the top portion of the support leg is designed as a landing to support a stop plate that is mounted onto the support assembly or lift mount assembly. In one specific embodiment, the stop plate engages the top portion of the support leg when the support assembly is disconnected from the frame mount assembly.

In accordance with a further aspect of the present invention, the lift mount assembly includes one or more auxiliary lights. When the complete snowplow mount assembly is secured to a vehicle, the headlights of the vehicle may to partially or totally blocked. In such situations, auxiliary headlights should be used. The lift mount assembly is designed to enable one or more auxiliary lights to be connected to the lift mount assembly. In one embodiment, the one or more legs of the lift mount assembly includes a connector location that is designed to connect to an auxiliary light and/or mount for an auxiliary light. In a specific embodiment, the legs of the lift mount assembly include a plurality of connector locations. The plurality of connectors allows the auxiliary lights to be used in association with a wide variety of vehicles. In another specific embodiment, the connector locations are openings in the legs to allow a pin, bolt or the like to be inserted there through.

In accordance with still another aspect of the present invention, the plow mount assembly includes a skid plate. In one embodiment, the skid plate is secured to or near the front of the plow mount assembly. In another embodiment, the skid plate elevates at least one end of the plow mount assembly above the ground to facilitate in the attachment and/or detachment of the plow mount assembly from the support assembly, the attachment and/or detachment of the support assembly from the frame mount assembly, and/or limit or prevent damage to the frame mount assembly during operation of the snowplow. In yet another embodiment, the skid plate is adjustably secured to the plow mount assembly so that the height of at least one end of the plow mount assembly can be adjusted from the ground. In one specific embodiment, washers are used to adjust the length the skip plate. In another specific embodiment, the skid plate has a generally circular base portion.

In accordance with another embodiment of the present invention, the snowplow blade includes a deflector flap which extends downwardly from the top of the plow blade. The deflector flap is designed to prevent snow and other debris from being propelled forwardly at high velocities from the snowplow blade during snowplow operation. Various types of debris such as large pieces of ice, rocks and the like can be thrown at relatively high velocities from the snowplow blade during a snowplow operation. These thrown objects can result in damage to other vehicles and/or other structures during the snowplow operation. The deflector flap is designed to interfere with the path of these objects prior to leaving the snowplow blade, thereby reducing the velocity of such objects and/or deflecting such objects downwardly toward the road surface. In one embodiment, the deflector is made up of a resilient flexible material which is designed to both deflect high velocity objects and to resist wear during operation. The flexibility of the deflector prevents the deflector from shattering during operation and helps to dampen the velocity of the projected materials. In one specific embodiment, the deflector is made of a rubber material. Such a material is resilient to wear and corrosion, is flexible yet resilient enough to deflect materials being expelled from the snowplow blade. In another embodiment, the deflector can be mounted in a variety of orientations with respect to the top of the snowplow blade. In one specific embodiment, the deflector is positioned substantially perpendicular to the top edge of the snowplow blade thereby functioning as a wall to debris which are being propelled outwardly from the top section of the snowplow blade. In another specific embodiment, the deflector extends less than a third of the distance downward from the top edge of the snowplow blade. In still another specific embodiment, the deflector extends about 3–20% the total elevation of the snowplow blade. Such an orientation and size of the deflector results in the deflector only contacting a small portion of the debris being plowed and expelled by the snowplow, thereby enabling the snowplow to effectively remove the desired debris from a ground surface and to prevent high velocity debris from being propelled from the snowplow blade. In still another embodiment, the deflector is mounted to the top of the snowplow blade so that it can be easily removed and replaced. In one specific embodiment, the mount arrangement includes a bracket and bolt arrangement, or the like.

In accordance with still yet another aspect of the present invention, there is provided a snowplow mount assembly wherein the plow mount assembly and/or the lift mount assembly can be easily connected and/or disconnected from the vehicle. In such an arrangement, a support assembly connects to both the plow mount assembly and the lift mount assembly such that the whole unit can be easily removed and/or a portion of the unit can be easily removed from the vehicle as desired. In one preferred arrangement, the simple removal of one or two bolts or pins from the support assembly disengages the plow mount assembly from the support assembly. In another embodiment, the simple removal of a few bolts or pins from the support assembly results in the detachment of both the plow mount assembly, the lift mount assembly, and the support assembly from the frame mount assembly. The components of the support assembly, lift mount assembly and plow mount assembly can be oriented so that when the components are completely removed from the frame mount assembly, they can be easily stored for later use and reattachment.

It is accordingly a primary object of the present invention to provide improvements in connection of snowplow mount assemblies to the front end of a vehicle for elevating and/or lowering a plow blade mounted on a vehicle.

Another object of the present invention is the provision of an assembly which reduces stresses applied to the vehicle frame and/or supporting portions of the assembly when the snowplow blade is elevated.

A further object of the present inventions is the provision of an assembly which enables quick release and/or removal of the components of the assembly from the vehicle.

Still yet another object of the present invention is the provision of an assembly which is independent of the vehicle bumper.

Still yet a further object of the present invention is the provision of an assembly in which the structure and location of the frame mount assembly relative to the bumper and/or vehicle body promotes the aesthetic value of the front end of the vehicle during non-snowplow use when the plow blade lift unit and/or the plow mount attachment are disconnected from the vehicle.

Still another object of the present invention is the provision of a frame mount assembly which is positioned behind the vehicle bumper to minimize and/or eliminate the projection of the components forwardly of the front of the bumper.

Yet a further object of the present invention is the provision of an assembly which has a lighter weight structure and/or which has a structural integrity to properly support a snowplow blade in an elevated and/or unelevated position and which promotes the life of the components and/or minimizes maintenance and/or replacement costs of the components of the assembly.

Another object of the present invention is the provision of an assembly which enables the operator to easily connect and/or disconnect various components of the assembly from the vehicle.

A further object of the present invention is the provision of an assembly which enables the attachment and/or detachment of the lift mount assembly, support assembly and/or plow mount assembly in a safe, sufficient, and/or convenient manner.

It is still yet another object of the present invention is the provision of providing improvements in an assembly mountable on a vehicle for elevating and/or lowering the plow blade.

Another object of the present invention is the provision of an assembly which enables quick release of the support assembly from the frame mount assembly during periods of non-snowplow use of the vehicle.

Still another object of the present invention is the provision of an assembly which enables quick release and/or removal of snowplow components and at the same time protects against unintentionally separation of component parts during snowplow operation.

Still yet another object of the present invention is the provision of an assembly which structural location of the frame mount assembly in relation to the bumper of the vehicle promotes safety of the vehicle during non-snowplow use of the vehicle when the support assembly is removed.

Still yet a further object of the present invention is the provision of an assembly which is less expensive to manufacture.

Still yet another object of the present invention is the provision of an assembly which includes a support assembly that connects to the lift mount assembly and/or the plow mount assembly to increase the simplicity of removal and/or attachment of such components to the vehicle.

Still yet another object of the present invention is the provision of an assembly which includes one or more stop plates to engage various components of the assembly when in the detached, lifted and/or retracted positions, and/or when being attached and/or detached from one another.

Another object of the present invention is the provision of a frame mount assembly which includes one or more guide flanges for easy attachment and/or detachment of one or more components from the landing.

Yet another object of the present invention is the provision of a lift arm on the lift mount assembly which height can be adjusted to accommodate a variety of different vehicles.

Still yet another object of the present invention is the provision of a support leg on the lift mount assembly which elevates an end of the plow mount assembly to simplify the ease of connecting and/or disconnecting components to the vehicle and/or to prevent damage of one or more components of the assembly.

Still yet another object of the present invention is the provision of a snowplow blade deflector which deflects one or more objects being propelled from the snowplow blade during operation.

Another object of the present invention is the provision of a plow mount assembly that includes an adjustable skid plate.

Yet another object of the present invention is the provision of a support leg that can easily adjust the height of at least one end of a plow mount assembly and which support leg can be easily and conveniently stored during non-use.

Still another object of the present invention is the provision of a snowplow mount assembly that includes auxiliary lights mountable to the snowplow mount assembly.

Still yet another object of the present invention is the provision of a snowplow mount assembly which includes connectors that are easy to handle and which are biased to facilitate in the securing together of one or more components of the snowplow mount assembly.

These and other objects and advantages will become apparent from the following description taken together with the accompanied drawings.

BRIEF DESCRIPTION OF THE DRAWINGS

The invention may take physical form in certain parts and arrangements of parts, a preferred embodiment of which will be described in detail and illustrated in the accompanied drawings which form a part hereof and wherein.

DETAILED DESCRIPTION OF THE PREFERRED EMBODIMENT OF THE INVENTION

Figure 1:
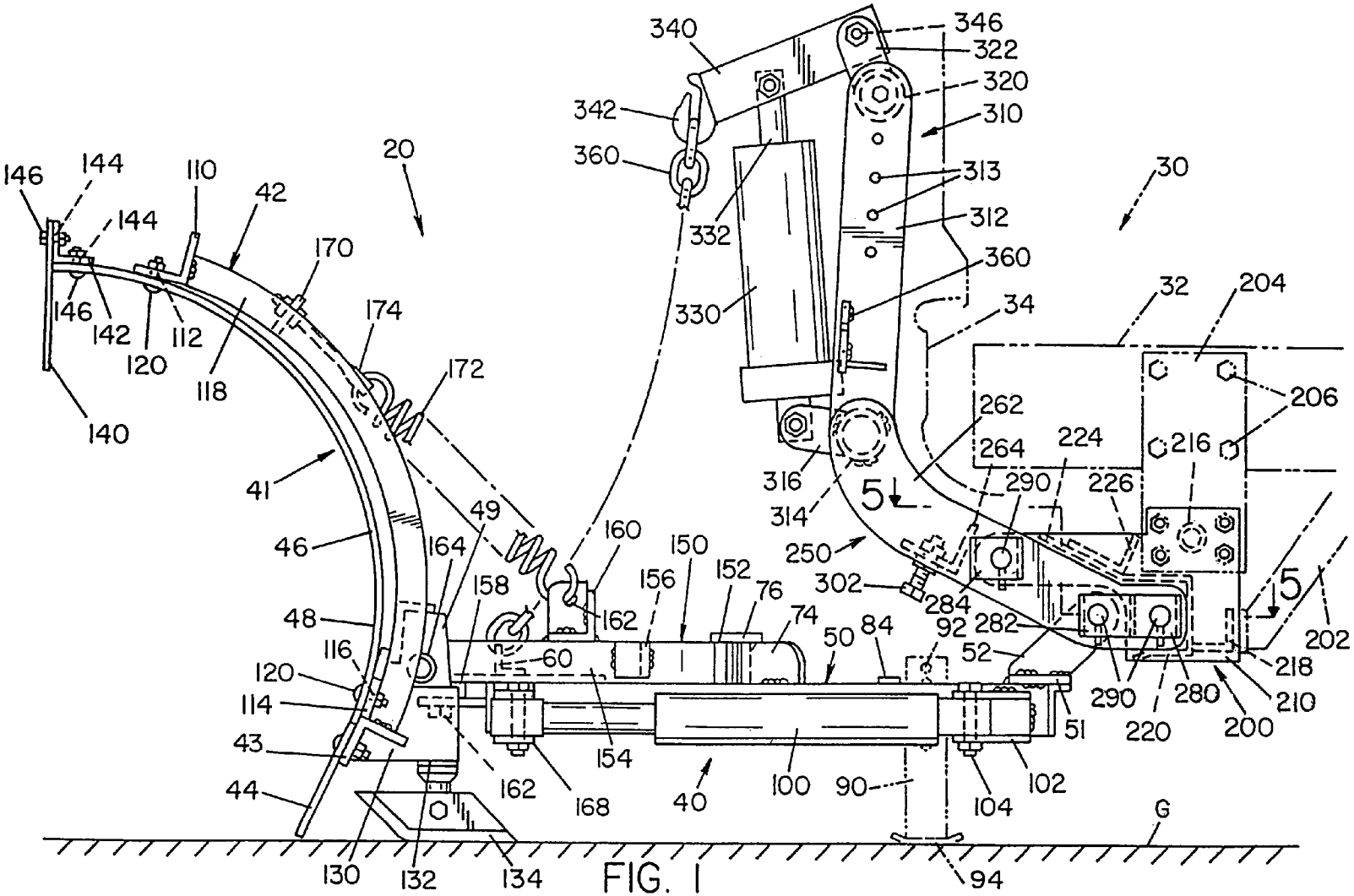
FIG. 1 is a left elevational view of the snowplow mount assembly in accordance with the present invention.

Referring now to the drawings wherein the showings are for the purpose of illustrating preferred embodiments of the invention only and not for the purpose of limiting the same, FIGS. 1–10 illustrate an improved frame snowplow mount assembly for operating a snowplow with the use of a vehicle. The snowplow mount assembly is suitable for use with large trucks, pick-up trucks, 4×4 vehicles, and the like for snow removal operations such as encountered in plowing driveways, parking lots, roads, etc. These snowplow blades are typically about 50–85 inches in length. For snowplow blades used in heavy duty snowplow removal such as by municipalities and government agencies for removing snow and debris from highways, the snowplow blade typically has a length of about 80–120 inches.

The snowplow mount assembly 20 is made up of four principal components, namely the frame mount assembly 200, which is secured to the frame members 32 of a vehicle 30 and positioned under and rearwardly of the vehicle bumper 34, a support assembly 250 secured to the frame mount assembly, plow mount assembly 40 secured to the support assembly and a lift mount assembly 310 which is also secured to the support assembly.

Referring now to FIGS. 1–4, plow mount assembly 40 includes a plow blade 41 having a generally longitudinally extending structural frame 42, a scraper blade 44 which is attached to the bottom of structural frame 42 and an inwardly curved mold board 46. For consistency of terminology as used herein, the scraper blade is the replaceable, lower edged portion of the plow blade, and the blade are the inwardly curved front face 48 of mold board 46 and the scraper blade 44. Plow blade 41 includes a structural frame 42, mold board 46 and scraper blade 44.

Figure 10:
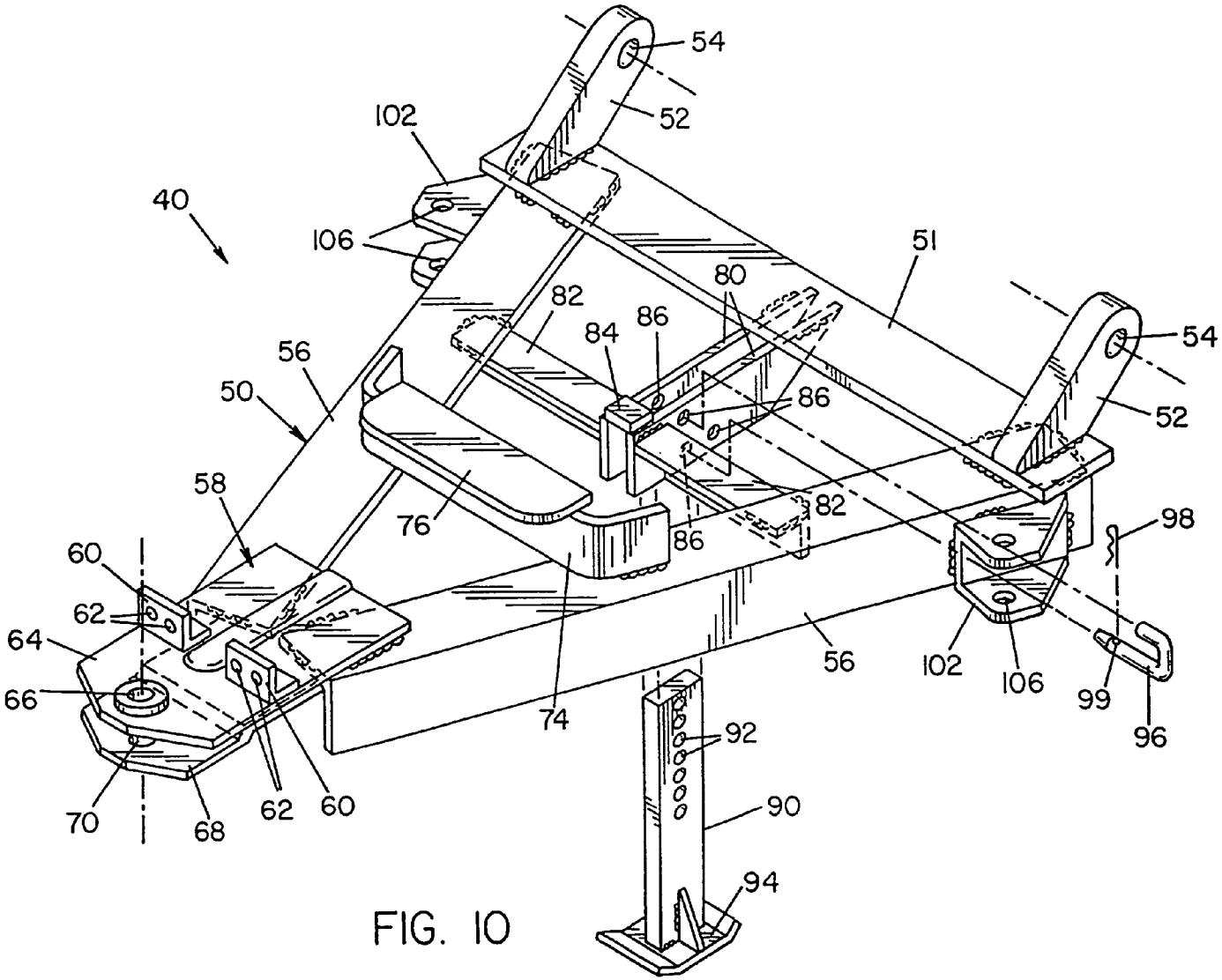
FIG. 10 is a still further detached front perspective view of the plow mount assembly without the snowplow blade.

Secured or attached to snowplow blade 41 is the A-frame 50 of the plow mount assembly. A-frame structure 50 is best shown in FIG. 10. The A-frame structure 50 includes a support cross-over arm 51 having journals 52 connected to the two ends of the cross-over arm. The two journals 52 include journal holes 54 for securing A-frame 50 to the support assembly 250. The A-frame 50 also includes two struts 56 which are connected at one end to the cross-over arm 51 and at the other end to a mount plate 58. Mount plate 58 includes a lift bracket 60 having bracket holes 62. The bracket holes 62 are designed to receive a rope or chain so that the plow mount assembly can be lifted and/or lowered by the lift mount assembly 310. Mount plate 58 includes an upper portion 64 and a lower portion 68, each of which include aligned openings 66, 70 respectively.

As shown in FIG. 1, an arcuate connector bar 150 is used to interconnect the plow blade 41 to mount plate 58. Arcuate bar 150 includes an arcuate shaped top portion 152 and two leg portions 154 attached to the top portion and extending outwardly therefrom. A support bar 156 that is secured between the two leg portions 154 to provide structural integrity to the arcuate connector bar. The arcuate connector bar also includes a mount landing 158 having an opening. The mount landing 158 is designed to be inserted between upper portion 64 and lower portion 68 of mount plate 58. The arcuate bar is connected to the mount plate by aligning openings 66, 70 in mounting plate 58 with opening in mount landing 158 and then inserting a bolt 162 through the holes. This connection allows the plow blade to pivot about the openings.

As shown in FIG. 1, the top portion 152 of arcuate bar 150 is held in a downward position by top plate 76. Top plate 76 is secured to mid-brace 74. Top plate 76 allows the arcuate bar to pivot from side to side about openings 66,70. The back end of struts 56 include cylinder brackets 102 for mounting a cylinder 100 in bracket openings 106 by a bracket bolt 104. The other end of cylinder 100 is secured to cylinder brackets 168 that are connected to leg portions 154 of arcuate bar 150. The cylinders, which are mounted on each side of the A-frame, permit angling of the plow blade 41 about openings 66, 70 so that the latitude of the plow blade 41 relative to the vehicle can be skewed to discharge snow from one side or the other of the plow blade.

As shown in FIG. 1, arcuate bar 150 is connected to plow blade 41 to allow the plow blade to also rotate in a forward and backward direction. At each end of leg portions 154 is a pivot opening 164 which pivotally connects to pivot trunnions 49 that are connected to the back face of the plow blade. Arcuate bar 150 includes two trunnions 160 connected to each leg portion 154. Each trunion 160 has a trunnion opening 162. Plow blade 41 also includes two trunnions 170 secured to the structural frame 42 and/or curved braces 118. Trunnions 160, 170 provide for the mounting of spring 172 which maintains the plow blade 41 in an upward position. When scraper blade 44 engages an obstacle in the roadway, plow blade 41 pivots about arcuate bar 150 against the action of the two springs 172 which return the plow blade 41 to its normal position after passing over the obstacle. The tension of springs 172 is adjusted to a conventional manner by adjustable arms 174 threaded to trunnion 170.

Referring again to FIGS. 1–4, structural frame 42 of the snowplow 41 is a conventional frame and comprising a longitudinally extending to mounting member 110 which extends the length of the snowplow, a longitudinally extending bottom mounting member 114 which similarly extends the length of the plow blade, and a plurality of transversely spaced inwardly curved braces 118 which extend between and are secured to the top and bottom mounting members 110, 114. Both mounting members 110 and 114 include mounting holes 112, 116 respectively to enable the mounting members to be secured by mount bolts 120 to mold board 46 of plow blade 41. In practice, mounting members 110 and 114 are L-shaped structures which include one leg radially extending from back surface of plow blade 41. Braces 118 are also structurally angled components which are oriented to have an L-shaped or V-shaped cross-sectional configuration. The braces are commonly welded to both the mounting members 110 and 114.

The mold board is a rectangular flat sheet, approximately ⅜ inches thick of ultra-high polymer or ultra-high molecular weight polyethylene plastic. The polyethylene material has a low coefficient of friction, relatively high resistant to abrasion, and adequate impact and yield strength to function in a snowplow environment. The mold board is formed into a curvilinear shape. As can be appreciated, the mold board 46 may be formed from other materials, such as, but not limited to hardened steel.

Scraper blade 44 has a bottom edge which is designed to contact the roadway to picking up snow in a known manner and is secured to curve braces 118 and/or bottom mounting member 114 by a scraper bracket 43. Scraper blade 44 commonly extends on the complete longitudinal length of the bottom edge of the snowplow blade. Scraper blade 44 is commonly made of a durable rubber material or metal material.

The mold board 41 is formed to have an arcuate segment having a radius which is dependent on the size of the plow blade. For smaller plow blades, the radius of the arc is about 9–14 inches, while for larger plows, the radius of the arc is about 13–20 inches. As best shown in FIG. 1, the top edge of plow blade 41 extends beyond the top mounting member 110 of structural frame 42 until the plane of the inside surface of the plow blade is or is closely parallel to the ground surface G.

Attached to the top edge of plow blade 41 is a deflector flap 140. Deflector flap 140 is secured to flap bracket 142 which in turn is secured to the top edge of plow blade 41. Flap bracket 142 includes bracket openings 144 to allow bracket bolts 146 to secure the deflector flap 140 to the flap bracket and to secure flap bracket 142 to the top edge of plow blade 41. Deflector flap 140 extends downwardly from the top edge of plow blade 41 and functions as a barrier to snow and other debris which are traveling along the upper inner surface of snowplow blade 41 during snowplow operation and prevents such snow and debris from being propelled from snowplow blade 41 at high velocities. The deflector flap 140 is preferably made up of a durable flexible material such as a hard rubber and/or plastic.

As shown in FIGS. 1–4, secured to the bottom mounting member 114 is a skid bracket 130 having a threaded bore 132 for adjustably receiving a skid plate 134. Further details about the design and manufacture of the plow blade 41 are disclosed in Assignee's U.S. Pat. No. 4,803,790 and co-pending U.S. patent application Ser. No. 09/215,812, both of which are incorporated herein by reference.

Figure 2:
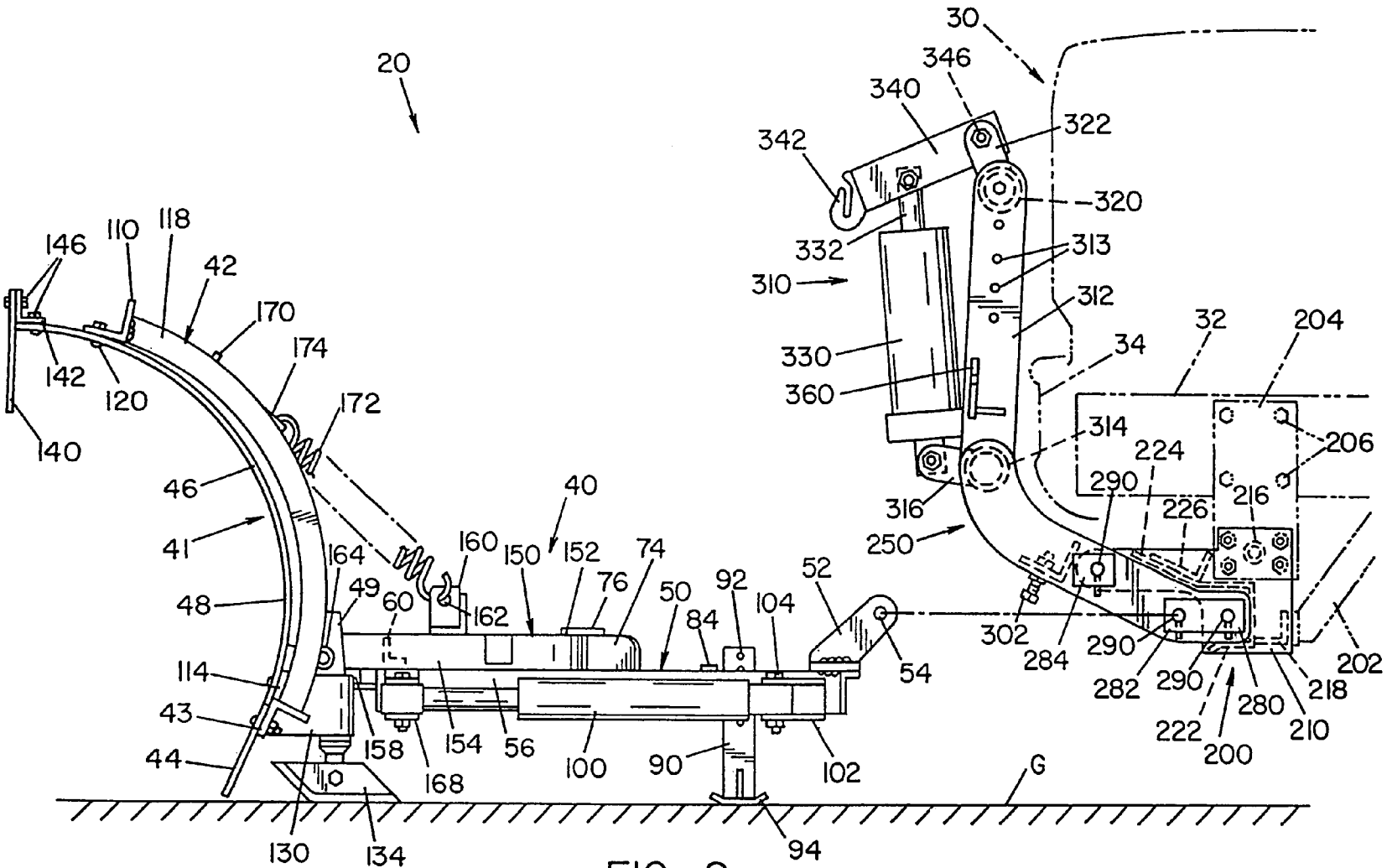
FIG. 2 is a view of the snowplow mount assembly as shown in FIG. 1 wherein the plow mount assembly is detached from the support assembly.
Figure 3:
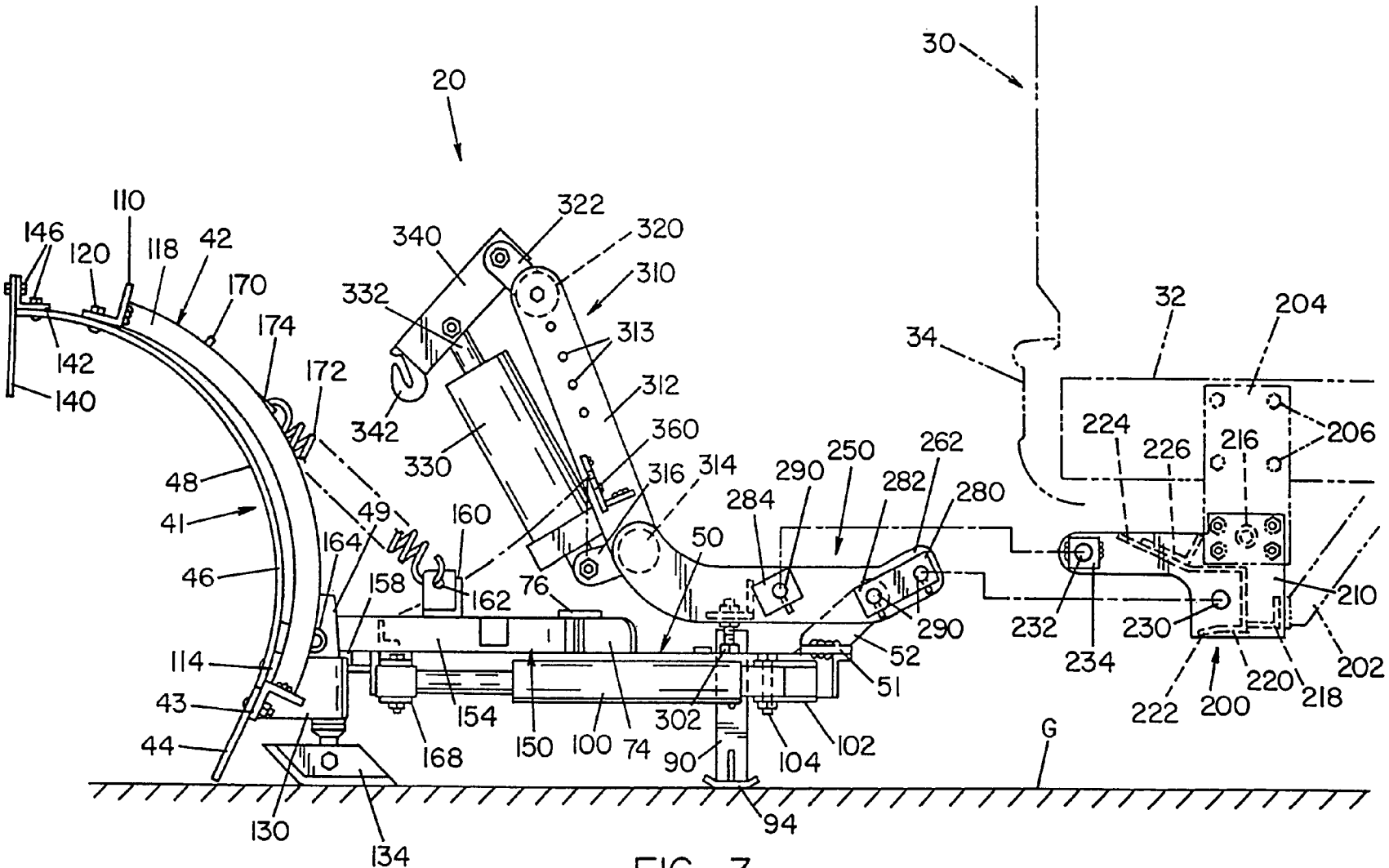
FIG. 3 is a view of the snowplow mount assembly as illustrated in FIG. 1 wherein the support unit is detached from the frame mount assembly.
Figure 4:
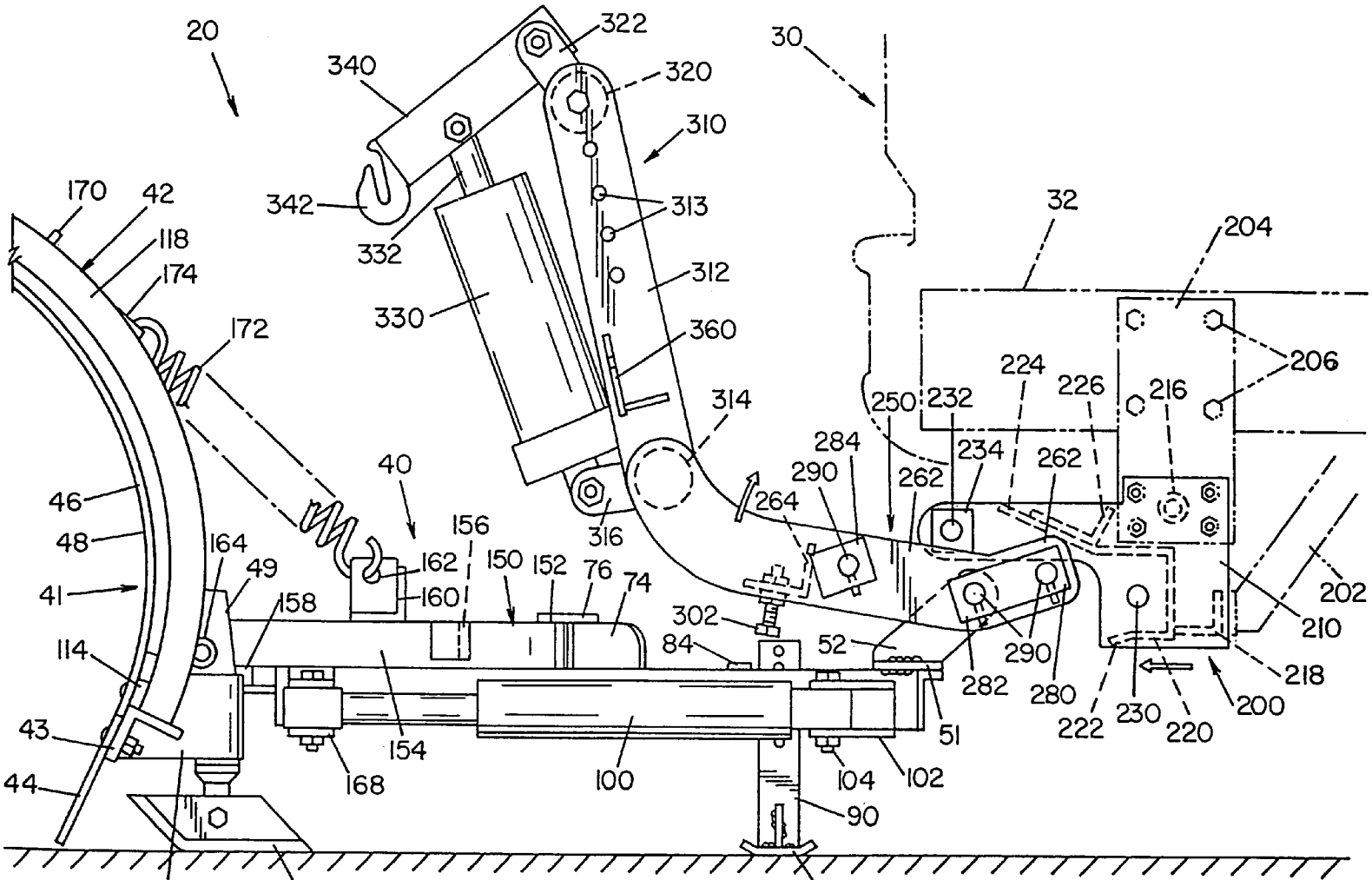
FIG. 4 is an enlarged view of FIG. 1 illustrating the reattaching of the support assembly to the frame mount assembly.
Figure 6:
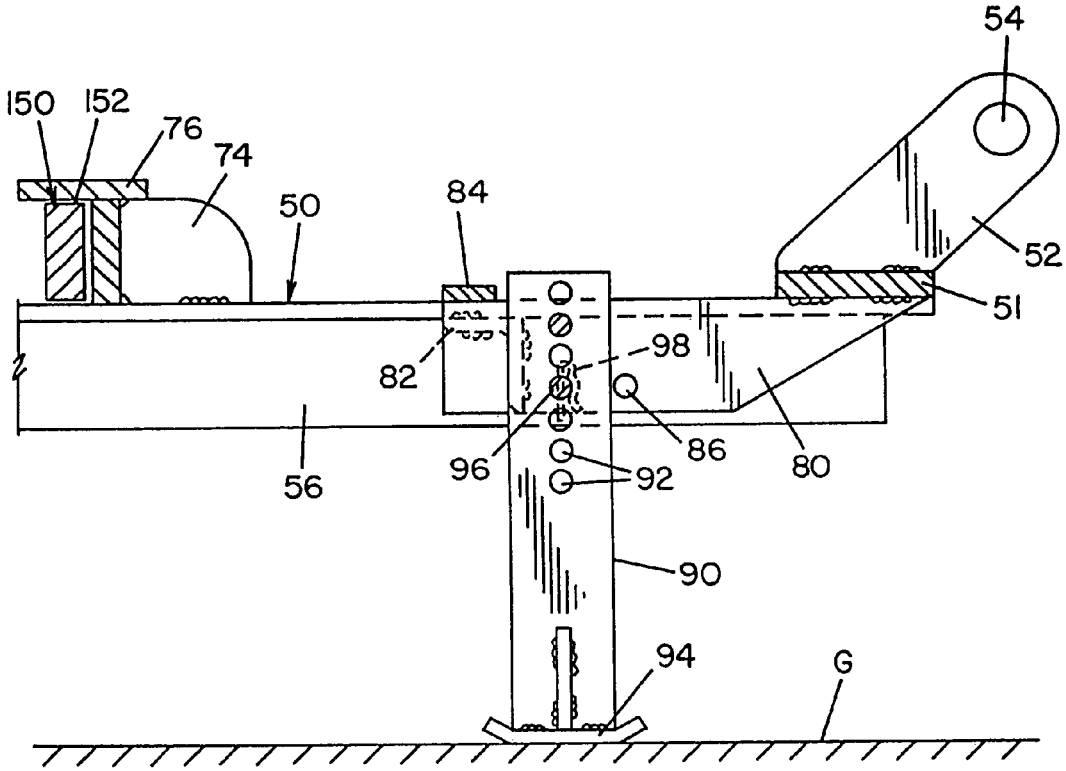
FIG. 6 is an enlarged side perspective view of the plow mount assembly illustrating the stand on the plow mount assembly in a support position.
Figure 7:
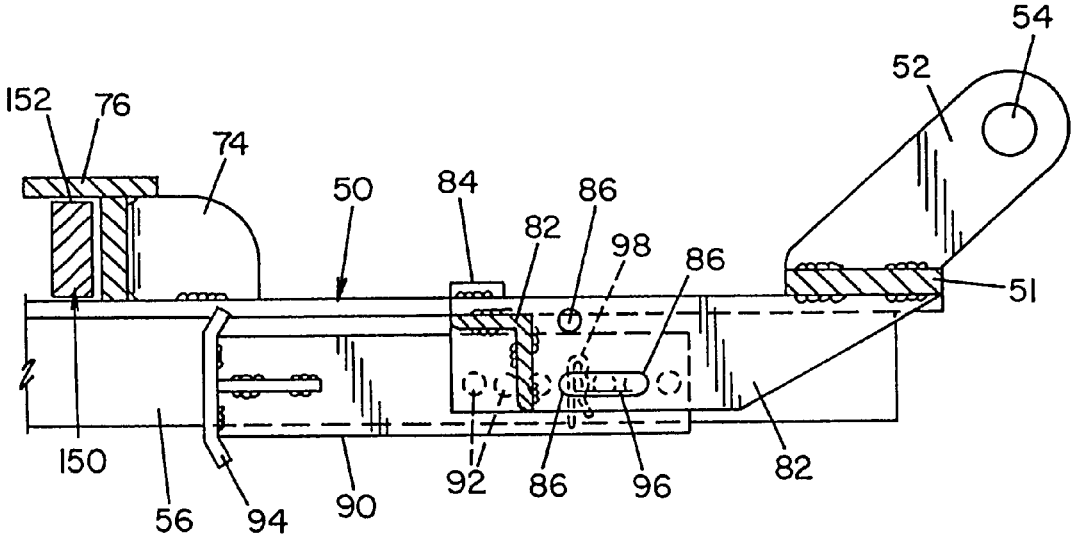
FIG. 7 is a fragmentary elevational view of the plow mount assembly illustrating the stand on the plow mount assembly in a retracted position.

Referring now to FIGS. 6, 7 and 10, the A-frame 51 of the plow mount assembly includes a stand 90 which is mounted between two parallel positioned stand flanges 80. Stand flanges 80 are secured at one end to support cross-over arm 51. The other ends of the two stand flanges are connected to flange braces 82 which are in turn are connected to struts 56. A flange plate 84 secures the top end edges of the stand flanges together. Each stand flange include three flange openings 86 which are aligned to one another and are designed to mount stand 90 in a support position and a retracted position. Stand 90 includes a stand shoe 94 and a plurality of stand openings 92 to adjustably secure stand 90 to stand flange 80. A stand pin 96 is used to secure stand 90 to stand flange 80 and a pin clip 98 is designed to be positioned in a pin openings 99 for securing stand pin 96 in a secured or locked position. Referring specifically to FIG. 6, stand 90 is in a support position whereby stand shoe 94 engages the ground surface G and elevates the back end of the A-frame from the ground surface. Stand 90 is positioned in the support position when the plow mount assembly 40 is to be attached and/or detached from support assembly 250, and/or when support assembly 250 is to be attached and/or detached from the frame mount assembly of the snowplow mount assembly 20. FIG. 7 illustrates the stand in the retracted position and is maintained in such position when the snowplow is in use. As can be appreciated, holes 86 are positioned in such a manner that stand pin 96 can be used to mount the stand in the support position and in the retracted position. As best illustrated in FIGS. 2–4, stand 90, when used in conjunction with skid plate 134 supports both ends of the A-frame and the plow blade in an elevated position so that the plow mount assembly and/or support assembly can be easily attached to and/or detached from the frame mount assembly of the snowplow mount assembly 20.

Figure 8:
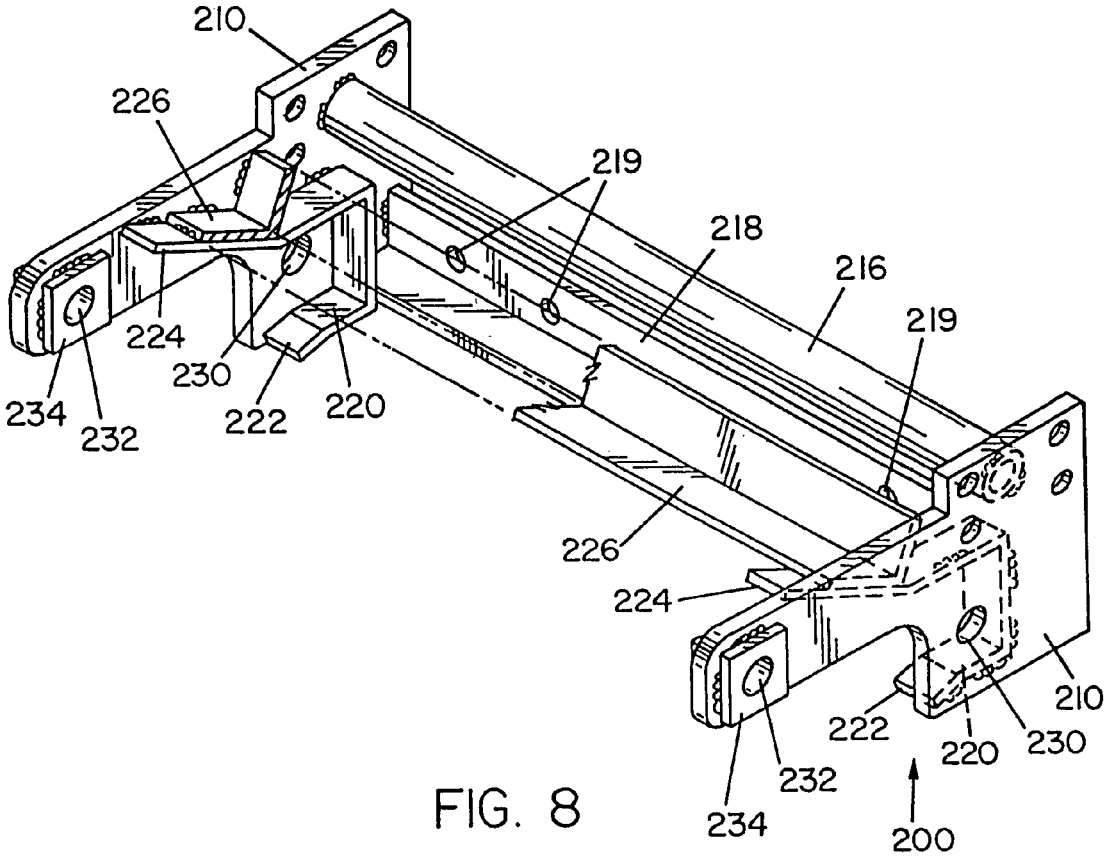
FIG. 8 is a detached front perspective view of the frame mount assembly.

Referring now to FIGS. 1 and 8, frame mount assembly 200 is shown as being secured to the underside of the vehicle. As shown in FIG. 1, two support struts 202 are attached at one end to the vehicle frame members 32 and the other end of support strut is secured to bracket plate 218 and is secured by bolts secured within plate opening 219. The frame mount assembly also includes a frame plate 204 which is secured by plate bolts 206 to frame members 32. The frame plate and support struts rigidly secure mounting bracket 210 to frame members 32 and rearwardly of bumper 34.

Referring specifically to FIG. 8, the two mounting brackets 210 are secured together by bracket brace 216, arm bracket 226, and bracket plate 218. These three structures maintain the rigidity of the mounting brackets while supporting the other members of the snowplow mount assembly. Secured to the inside surface of each of the mounting brackets is a landing 220 having a C-shaped structure. Landing 220 is designed to receive a portion of the support assembly as will be described below. Landing 220 includes a lower lip 222 which angles downwardly from landing 220. Landing 220 also includes an arm bracket which extends from the upper edge of the landing and angles upwardly from landing 220. Extension arm 224 is supported in position by arm bracket 226. Both arm bracket 226 and bracket plate 218 have an L-shaped configuration to provide additional rigidity to the frame mount assembly. Preferably, bracket brace 216, landing 220, lip 222 extension arm 224, arm bracket 226, and bracket plate 218 are welded to the inner surface of the two mounting brackets 210. Mounting bracket 210 also includes support openings 230 and 232. Support opening 230 is designed to align with an opening in a portion of the support assembly to thereby secure the support assembly to landing 220. Support opening 232 is designed to align with another opening in the support assembly to rigidly secure the support assembly to the frame mount assembly. Support opening 232 includes opening supports 234 on both sides of the opening to reinforce the opening and reduce the amount of wear within the opening.

Figure 5:
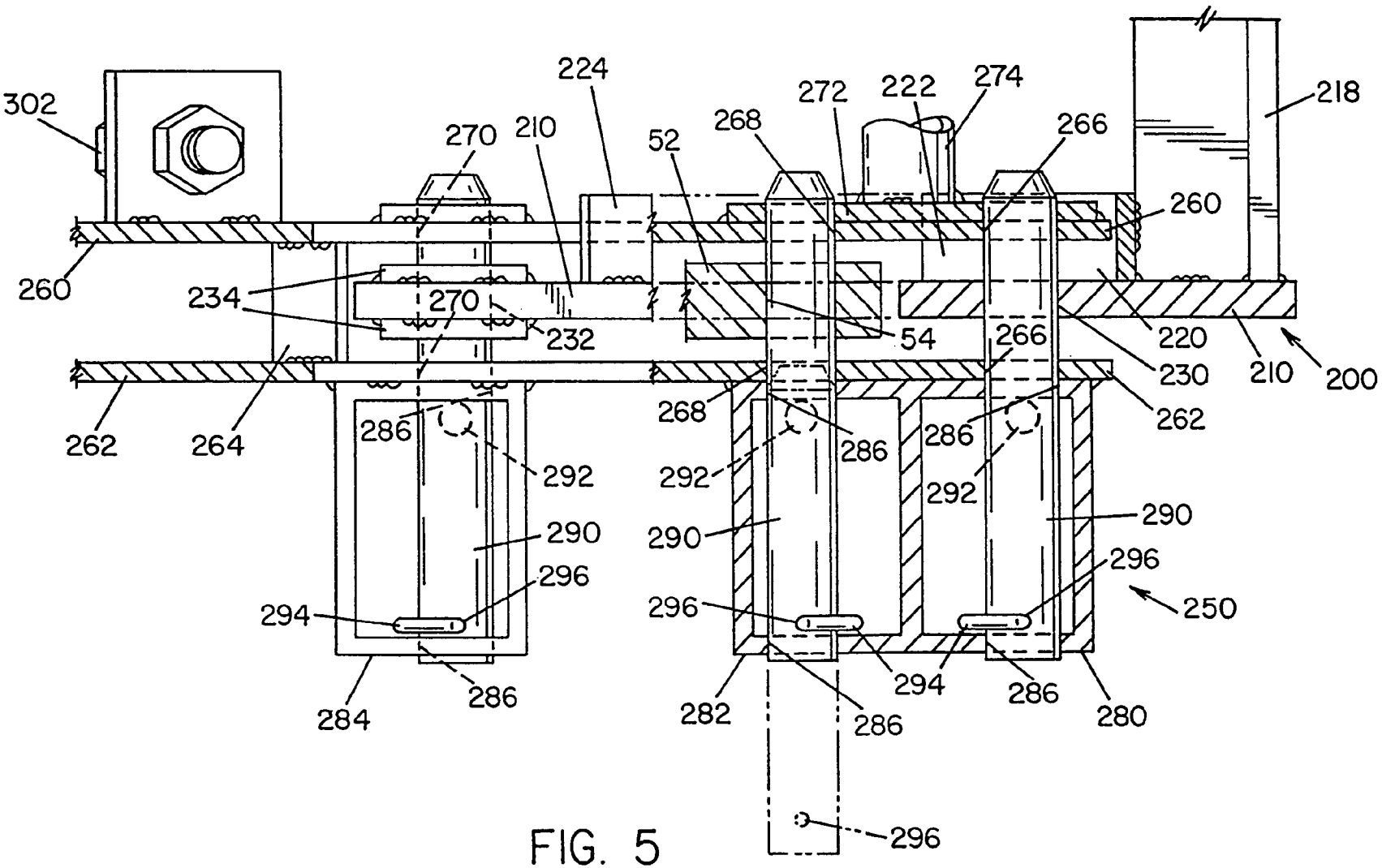
FIG. 5 is a further enlarged cross-sectional view taken along lines 5—5 in FIG. 1.

Referring to FIGS. 1–4 and 9, support assembly 250 includes a pair of inner legs 260 and a pair of outer legs 262. The inner legs and outer legs are laterally spaced apart. A leg brace 264 secures each pair of inner and outer legs together. A leg flange 272 is secured to the inner side of each of the inner legs by a leg flange 272 which in turn is connected to a leg bar 274. Leg flange 272 is welded to the inner side of the leg and leg bar 274 is preferably welded to the inner side of leg flange 272. Inner legs and outer legs include a plurality of openings for securing the support assembly to the frame mount assembly and to connect other components of the snowplow mount assembly to the support assembly. At one end of the inner leg and outer leg is a landing opening 266. Spaced from landing opening 266 is journal opening 268. Spaced from journal opening 268 is an upper support opening 270. Connected to the exterior side of outer leg 262 is a pin housing 280, 282 and 284. Pin housing 280 includes housing openings 286 which are aligned with landing opening 266. Pin housing 282 includes housing opening 286 which are aligned with journal openings 268. Pin housing 284 includes housing openings 286 which are aligned with upper support openings 270. Pin housings 280, 282, and 284 are designed to maintain a pin 290 within the housing. Pin 290 includes a pin stop 292 radially extending from the surface of the pin. Pin 290 also includes a pin opening 296 to receive a pin clip 294. Pin stop 292 limits the movement of pin 290 within the pin housing so as to prevent the pin from being completely removed from the housing. Pin clip 294 is designed to secure pin 290 in the extended position whereby the end of the pin extends into landing opening, journal opening and/or upper support opening. The positioning of pin 290 within the pin housing is best illustrated in FIG. 5.

Figure 9:
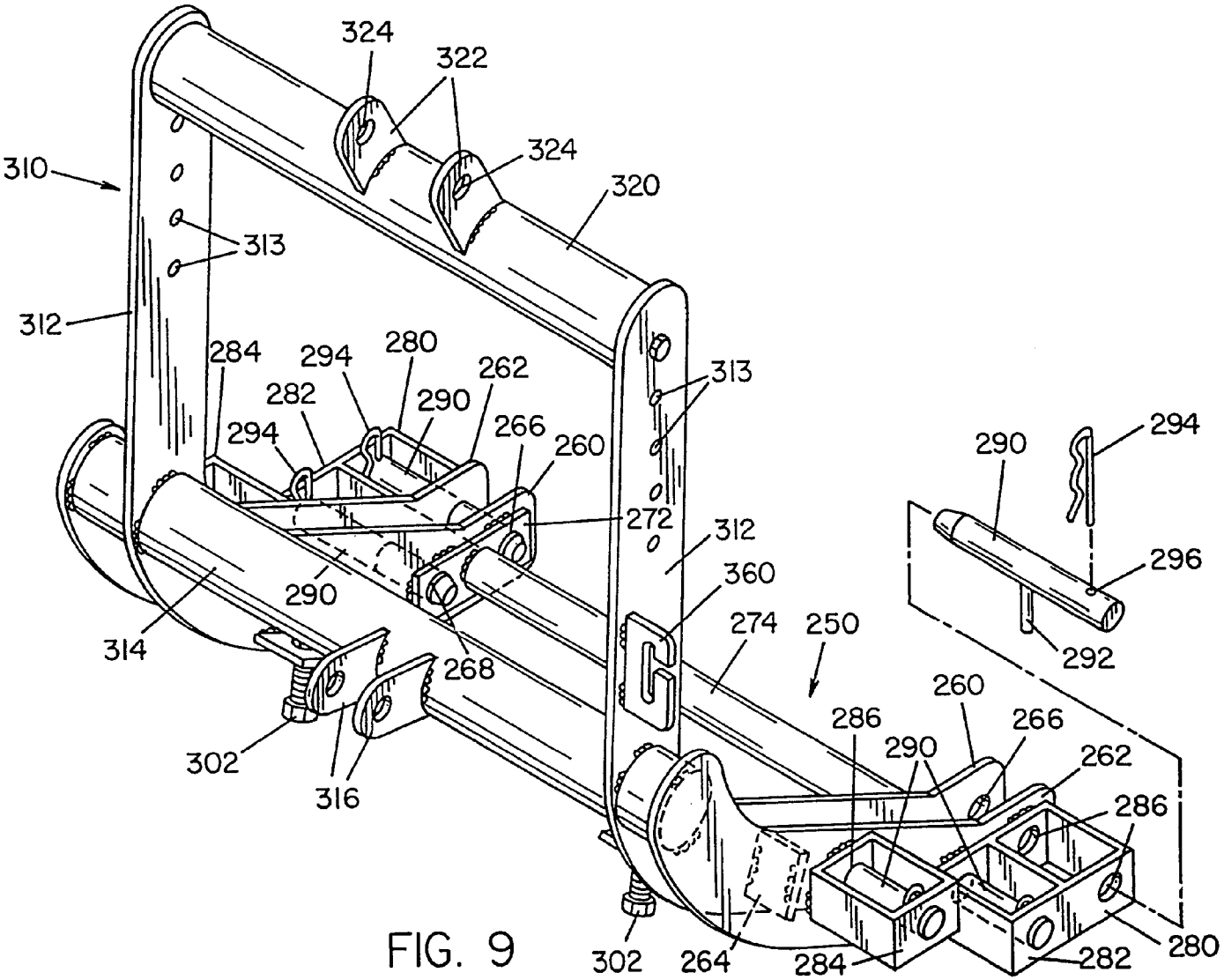
FIG. 9 is a further detached exploded front perspective view of the support assembly and lift mount assembly.

Referring again to FIG. 9, there is shown the lift mount assembly 310. Lift mount assembly 310 includes a pair of lift legs 312 laterally spaced from one another. A support bar 314 is secured between the two lift legs which in turn secures the lift legs to the inner leg and outer leg 260, 262 of the support assembly. As illustrated in FIG. 9, lift leg 312 is an extension of inner leg 260 of support assembly 250. In an alternate embodiment not shown, lift leg 312 is a separate component from inner leg 260. As can be appreciated, when lift legs 312 are separate components from inner leg 260, lift legs 312 can be mounted to support bar 314 in a manner that the lift legs are permanently affixed to support bar 314 with respect to inner legs 260 of the support assembly 250, or can be adjustably positioned with respect to the inner legs so that the angular position of the lift mount assembly with respect to the vehicle and with respect to the support assembly can be adjusted.

Referring once again to FIG. 9, each lift leg 312 includes a plurality of leg openings 313. Secured to one set of leg openings is a lift bar 320. Lift bar 320 includes a pair of bar brackets 322 laterally spaced from one another. Each of the bar brackets have a bracket opening 324. The leg openings 313 enable the lift bar 320 to be adjustably positioned vertically along the lift legs 312. The lift bar can be designed to be secure in a single or a plurality of positions about the longitudinal axis of the lift bar. As shown in FIGS. 1–4, an actuator 330 is secured to the lift mount assembly. A pair of acuator brackets 316 pivotly secure the base of the acuator to support bar 314. The piston 332 of acuator 330 is secured to lift arm 340 within bracket openings 322 by a pin, bolt or the like secured through bracket openings 324 and mount opening 346. The end of lift arm 340 includes a lift hook 342 to secure to a rope or chain 360.

The operation of the snowplow mount assembly 20 will now be described. As illustrated in FIG. 1, support assembly 250 is secured to frame mount assembly 200. Connected to the support assembly are plow mount assembly 40 and lift mount assembly 310. As previously discussed, frame mount assembly 200 is permanently affixed to frame members 32 of vehicle 30. frame mount assembly 200 is positioned on frame members 32 such that all of the components of frame mount assembly 200 are positioned below and rearwardly of the front end of bumper 34. Consequently, when support assembly 250 is removed from frame mount assembly 200, the components of frame mount assembly 200 cannot be seen by an individual unless the individual looks under the vehicle. Therefore, during non snowplowing months, the original aesthetic qualities of the vehicle are retained when support assembly 250 is removed from frame mount assembly 200.

Referring again to FIG. 1, snowplow mount assembly 20 is designed so that the components of the snowplow mount assembly can be easily attached and/or detached from the vehicle in a multitude of ways. As shown in FIG. 1, support assembly 250 is secured in frame mount assembly 200. Support assembly 250 is simply secured to frame mount assembly 200 by positioning the end of inner leg 260 onto landing 220 until landing opening 266 in inner leg 260 and outer leg 262 are aligned with support opening 230. Once these openings are aligned, pin 290 is moved in pin housing 280 and is inserted through all the openings. Pin clip 294 is then inserted through pin opening 296 to secure the pin in position. This procedure is repeated on the other set of inner leg 260 and outer leg 262 of support assembly 250. Support assembly 250 is then rigidly secured to the frame mount assembly by aligning upper support opening on inner leg 260 and outer leg 262 with support opening 232 on mounting bracket 210. Once the openings are aligned, pin 290 in pin housing 280 is moved through all the openings and pin clip 294 is used to secure pin 290 in position. Once this procedure is repeated on the other set of inner leg 260 and outer leg 262, the support assembly 250 is rigidly secured to frame mount assembly 200. As can be appreciated, support assembly 250 can be easily removed from frame mount assembly 200 by repositioning the four pins 290 in their respective pin housings of support assembly 250 thereby releasing the support assembly from frame mount assembly 200.

As illustrated in FIG. 1, lift mount assembly 310 is permanently secured to support assembly 250 due to the end of inner leg 260 of support assembly 250 being uniformly formed with the ends of lift legs 312 of lift mount assembly 310. Consequently, when support assembly 250 is rigidly secured to frame mount assembly 200, the securing of the support assembly also results in the securing of the lift mount assembly to the vehicle.

Plow mount assembly 40 is shown to be secured to support assembly 250 at a single location on each set of inner leg 260 and outer leg 262 of the support assembly. Plow mount assembly 40 is simple secured to support assembly 250 by aligning the journal holes 54 in journals 52 with journal openings 268 in inner leg 260 and outer leg 262. Once these openings are aligned with one another, pin 290 in pin housing 282 is moved so as to pass through all the openings. Once the pin has been properly positioned, pin clip 294 is secured into pin opening 296 to secure plow mount assembly 40 to support assembly 250. As can be appreciated, this mounting arrangement of plow mount assembly 40 to support assembly 250 allows the plow mount assembly 40 to pivot upwardly and downwardly about journal openings 268 to thereby allow the plow blade 41 to be lifted and lowered by lift mount assembly 310. When the plow mount assembly 40 is to be detached from support assembly 250, the two pins 290 are repositioned in pin housing 282 thereby releasing journal 52 from inner leg 260 and outer leg 262 of support assembly 250. After support assembly 250 is secured to frame mount assembly 200 and plow mount assembly 40 is secured to the support assembly, lift mount assembly 310 raises plow mount assembly 40 in the desired position so that plow blade 41 can effectively remove snow and other debris from a ground surface G.

Referring now to FIGS. 2–4, the design of the snowplow mount assembly 20 allows for one or more of the components of the snowplow mount assembly to be removed and/or secured to the vehicle. As shown in FIG. 2, plow mount assembly 40 is detached from the vehicle while support assembly 250 and lift mount assembly 310 remain secured to the vehicle. This arrangement may be desirable when the plow blade assembly needs to be repaired, or if the vehicle is to be used for purposes other than snowplowing. When the plow mount assembly 40 is the only component which is to be removed from the vehicle, stand 90 is positioned in the support position so that stand shoe 94 engages ground surface G. The stand is then secured in position by inserting stand pin 96 through stand opening 92 and pin clip 98 is then secured into pin openings 99 to secure the stand pin 96 within the stand opening 92. As can be appreciated, when stand 90 is positioned in the support position, plow mount assembly 40 is secured in a rested position since the two skid plates 134 support the front of the plow mount assembly and stand 90 supports the rear of the plow mount assembly. As can be appreciated, skid plates 134 and stand 90 reduce and/or relieve the stress on pin 290 which secures journal 50 on inner leg 260 and outer leg 262 of support assembly 250. As a result of the reduction or removal of stress, pin 290 can be easily repositioned within pin housing 282 thereby easily attaching and/or detaching journals 52 from support assembly 250. Once pin 290 is repositioned within pin housing 282 and withdrawing from the openings, vehicle 30 can be backed up thereby separating plow mount assembly 40 from support assembly 250. As can be appreciated, when plow mount assembly 40 needs to be reattached to support assembly 250, the vehicle is moved toward the two journals 52 on plow mount assembly 40 until support journals are aligned with opening 268 and inner leg 260. Once pin 290 is positioned through the openings, stand 90 is repositioned in the retracted position and the plow mount assembly can once again be used for removal of snow and debris from the ground surface.

Referring now to FIGS. 3 and 4, the support assembly 250 is shown as being detached from frame mount assembly 200. As shown in FIG. 3, support assembly 250 has been detached from frame mount assembly 200 but remains attached to plow mount assembly 40. As previously discussed, support assembly 250 can be simply removed from frame mount assembly 200 by repositioning the four pins 290 within pin housing 280, 284. Once the pins have been repositioned, the vehicle can be backed up, thereby causing the ends of inner leg 260 and outer leg 262 to be released from mounting bracket 210. When support assembly 250 is completely released from frame mount assembly 200, rest bolt 302 on support assembly 250 engages the top of snowplow mount assembly 20 thereby supporting the support assembly and lift mount assembly 310 on the top of plow mount assembly 40. As discussed above, when plow mount assembly 40 is to be detached from the vehicle, stand 90 is repositioned in the support position. As can be appreciated, when stand 90 is positioned in the support position, the stresses on pins 290 and support openings 230 and 232 of frame mount assembly 200 are reduced or removed thereby allowing pins 290 to be easily retracted withing pin housing 280 and 284 thus simplifying the detachment of support assembly 250 from frame mount assembly 200.

Referring now to FIG. 4, the configuration of landing 200, lip 222 and extension arm 224 facilitate in the attachment and/or detachment of support assembly 250 from frame mount assembly 200. As shown in FIG. 4, when support assembly 250 is to be reconnected to frame mount assembly 200, vehicle 30 is moved toward the ends of inner leg 260 and outer leg 262 on support assembly 250. As the vehicle is moved forward, the bottom edge of extension arm 224 engages the top edge of inner leg 260. As the vehicle continues to move forward, extension arm 224 slowly guides the ends of inner leg 260 toward alignment with support openings 230 and 232 and mounting bracket 210. As inner leg 260 moves into contact with landing 220, support assembly 250 pivots about journal hole 54 and journals 52 of plow mount assembly 40 so as to simultaneously move support assembly 250 and lift mount assembly 310 in the proper positions. Lip 222 helps to guide the bottom edge of inner leg 260 onto the landing. Once landing opening 266 is aligned with support opening 230, pin 290 within pin housing 280 is moved into position to thereby secure outer leg 262 and inner leg 260 on mounting bracket 210. The upper support opening 270 on inner leg 260 and outer leg 262 will now be in alignment or in close alignment with support opening 232 so as to allow pin 290 in pin housing 284 to be easily repositioned with little or no further repositioning of support assembly 250 withing frame mount assembly 200. Once the four pins are secured in position, support assembly 250, lift mount assembly 310, and plow mount assembly 40 are once again secured to the vehicle for snowplow operations. The stand is then repositioned in the retracted position prior to snowplow operation.

FIGS. 11–20 illustrate an alternate snowplow mount assembly for operating a snowplow with the use of a vehicle. The snowplow mount assembly 400 is made up of four principal components, namely the frame mount assembly 500, which is secured to the frame members 452 of a vehicle 450 and positioned under and rearwardly of the vehicle bumper 454, a support assembly 600 secured to the frame mount assembly, plow mount assembly 700 secured to the support assembly and a lift mount assembly 900 which is also secured to the support assembly.

Figure 20:
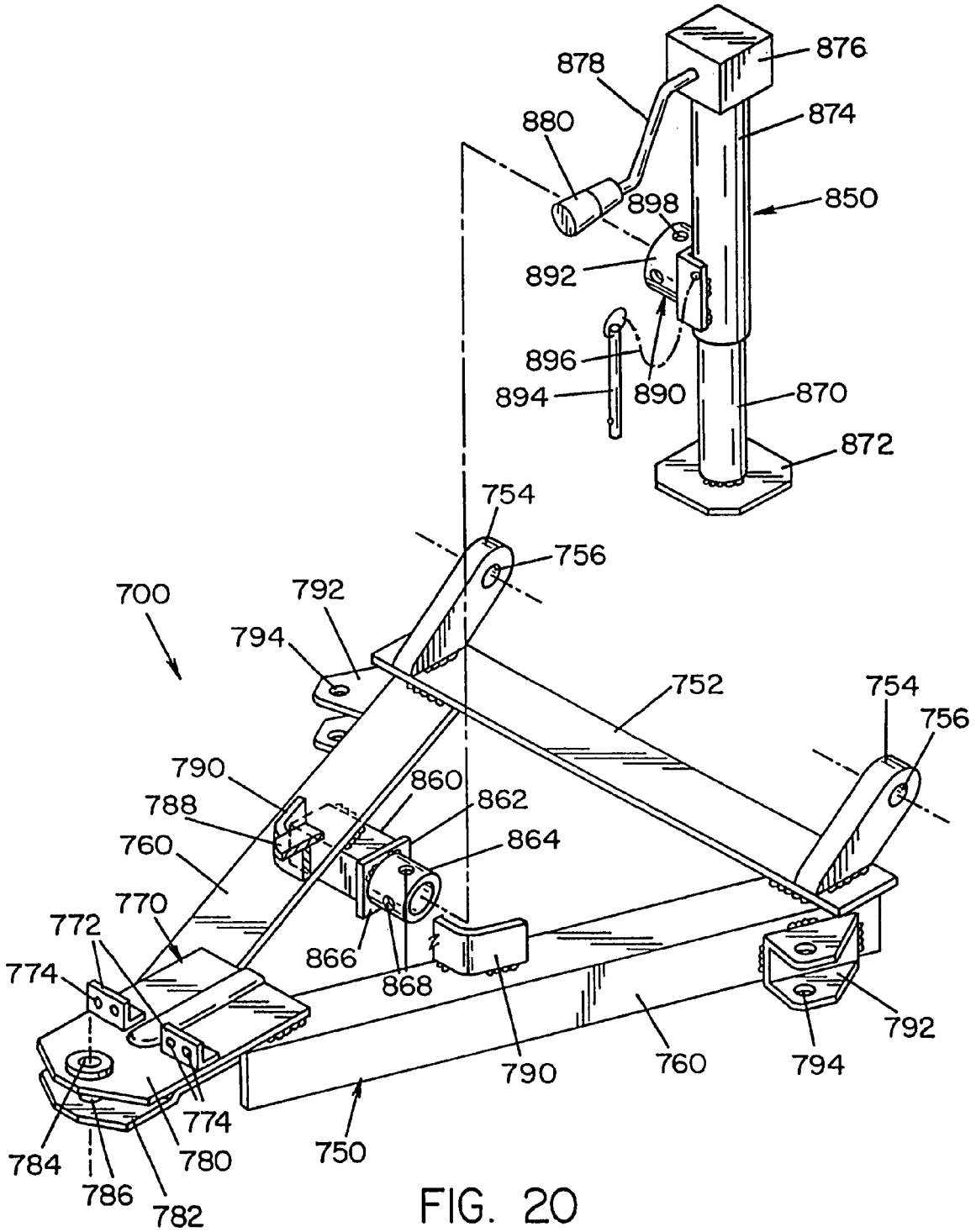

Referring now to FIGS. 11–13 and 20, plow mount assembly 700 includes a plow blade 710 which is essentially the same as plowblade 41 shown in FIGS. 1–4. Therefore the details of the plowblade will not be repeated in detail. Plowblade 710 a generally longitudinally extending structural frame 712, a scraper blade 714 which is attached to the bottom of structural frame 712 and an inwardly curved mold board 716. Secured or attached to structural frame 712 is A-frame 750. A-frame structure 750 is best shown in FIG. 20. The A-frame structure 750 includes a support cross-over arm 752 having journals 754 connected to the two ends of the cross-over arm. The two journals 754 include journal holes 756 for securing the A-frame to the support assembly 600. The A-frame also includes two struts 760 which are connected at one end to the cross-over arm and at the other end to a mount plate 770. Mount plate 770 includes a lift bracket 772 having bracket holes 774. The bracket holes 774 are designed to receive a rope or chain so that the plow mount assembly can be lifted and/or lowered by the lift mount assembly 900. Mount plate 770 includes an upper portion 780 and a lower portion 782, each of which include aligned openings 784, 786 respectively.

Figure 11:
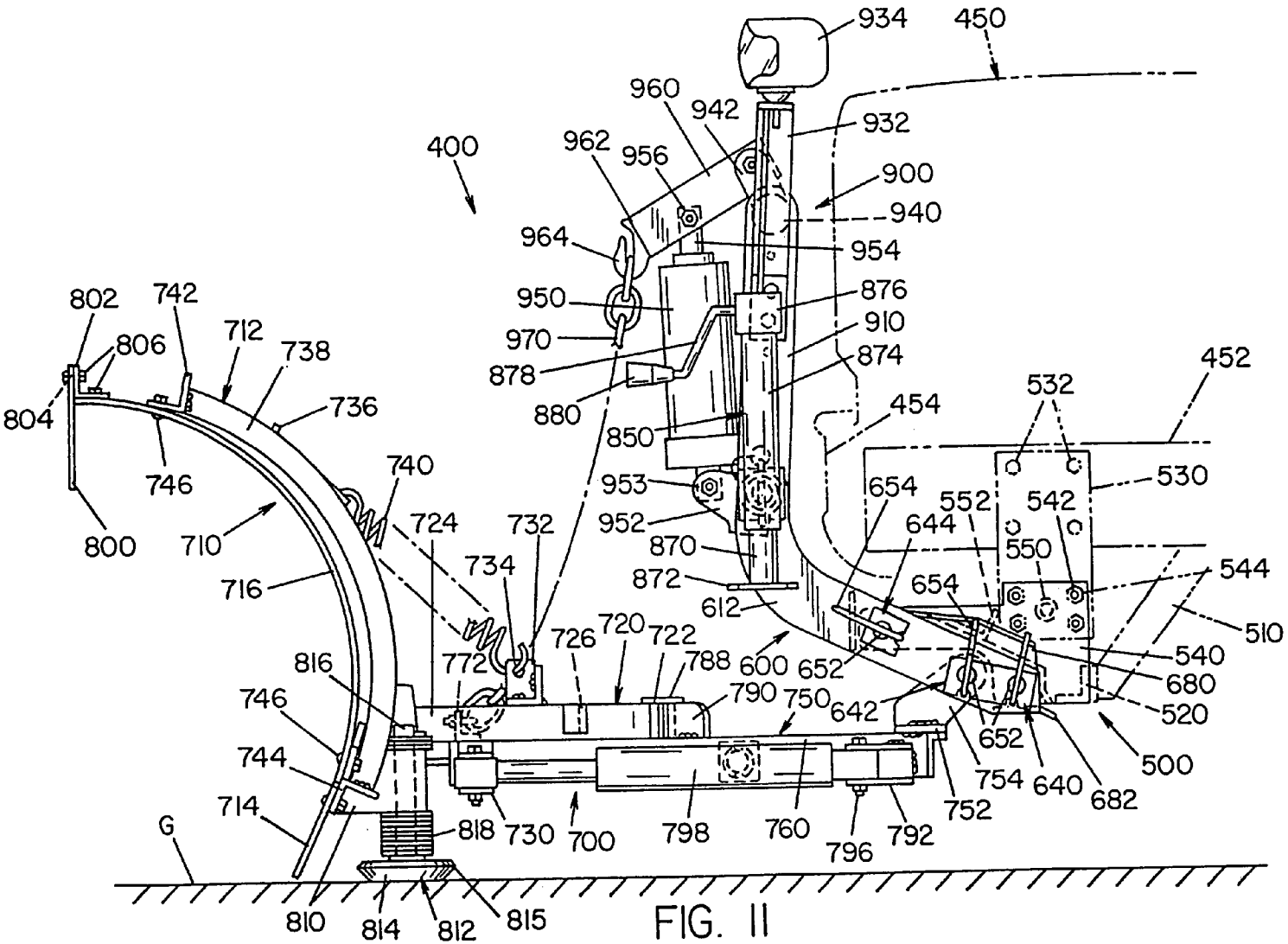
FIG. 11 is a view similar to FIG. 1 of an alternate embodiment of the snowplow mount assembly in accordance with the present invention.
Figure 12:
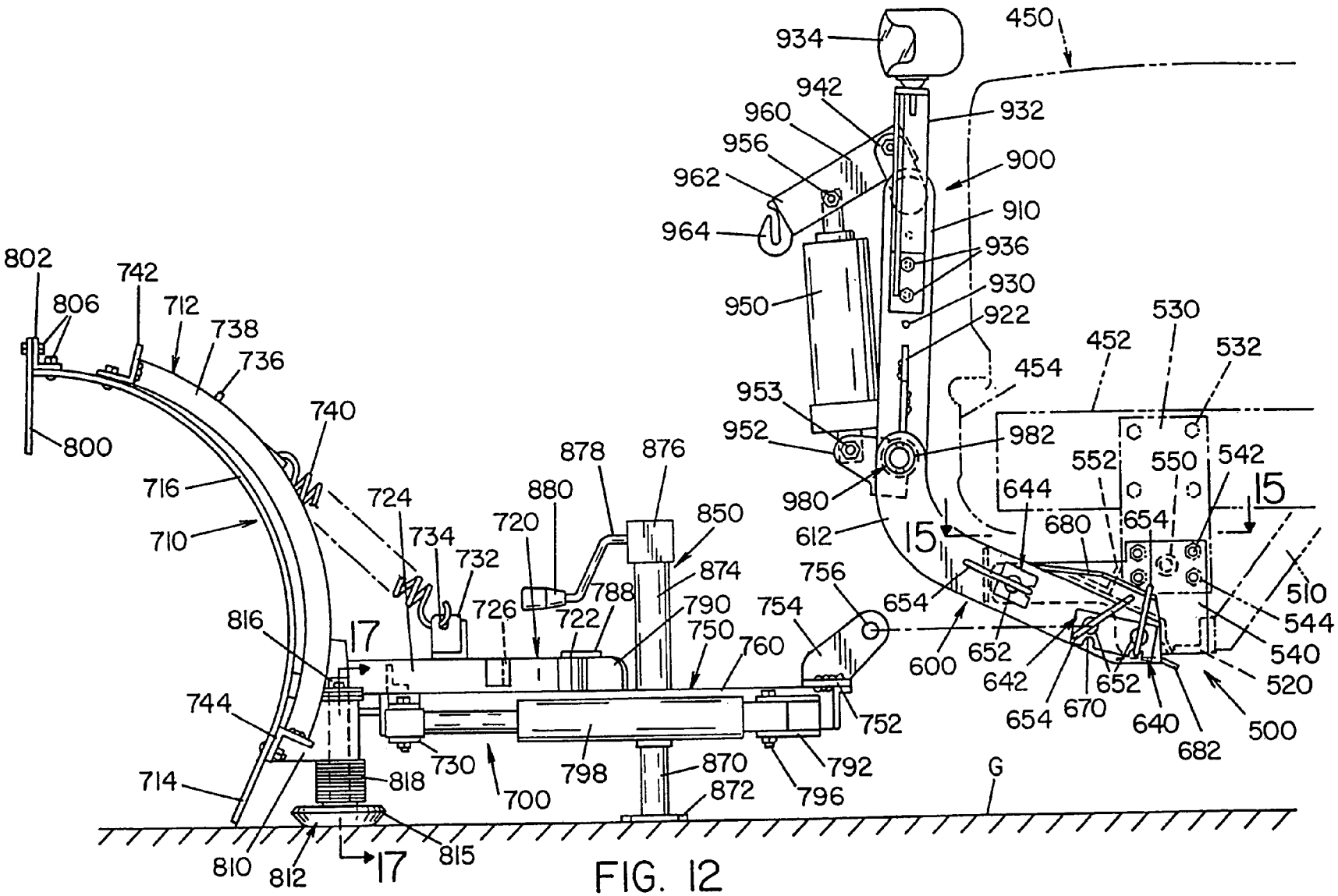
FIG. 12 is a view of the snowplow mount assembly as shown in FIG. 11 wherein the plow mount assembly is detached from the support assembly.
Figure 13:
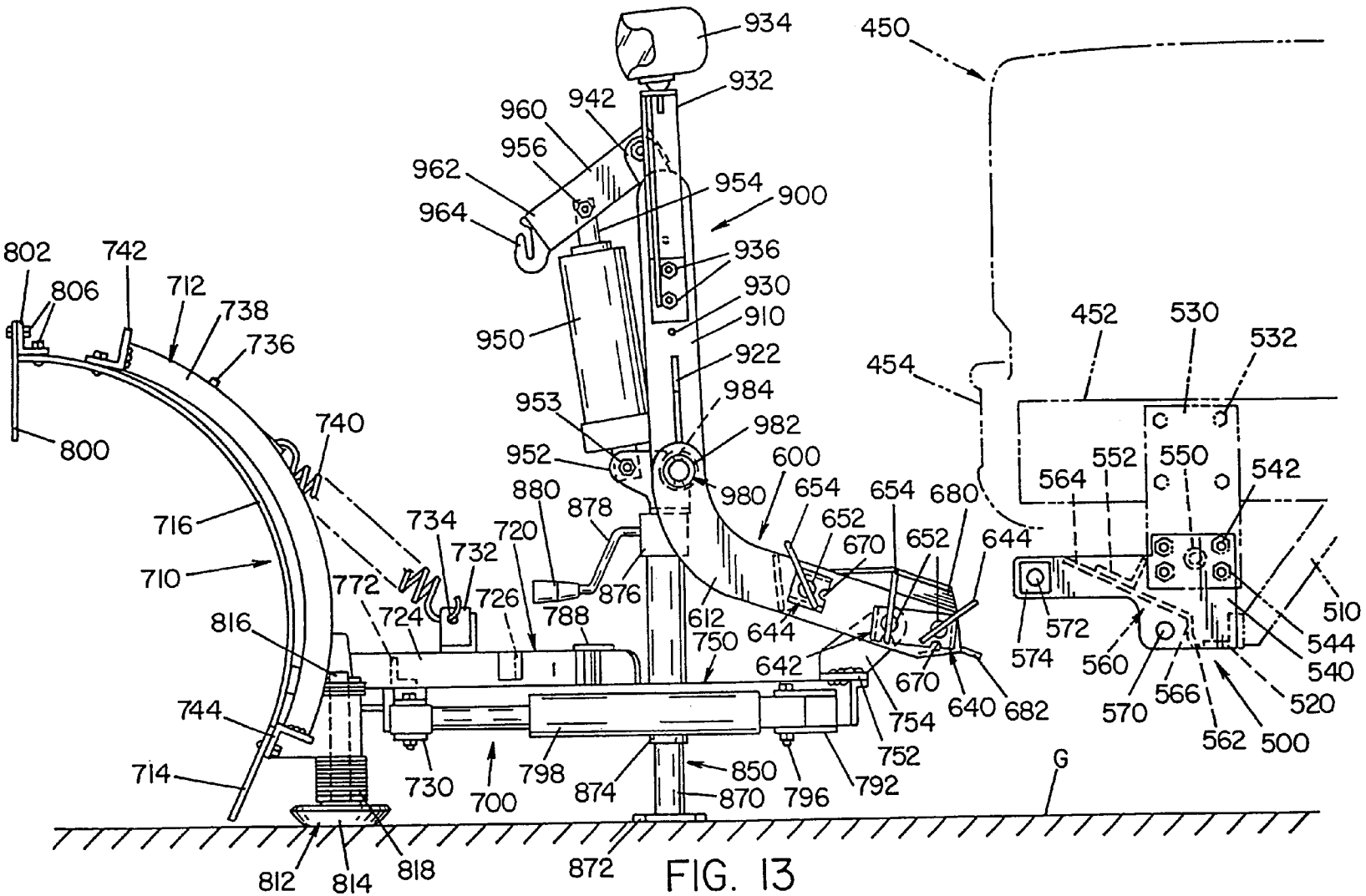
FIG. 13 is a view of the snowplow mount assembly as illustrated in FIG. 11 wherein the support mount assembly is detached from the frame mount assembly.

As shown in FIGS. 11–13, an arcuate connector bar 720 is used to interconnect the plow blade 710 to mount plate 770. Arcuate bar 720 includes an arcuate shaped top portion 722 and two leg portions 724 attached to the top portion and extending outwardly therefrom. A support bar 726 that is secured between the two leg portions 724 to provide structural integrity to the arcuate connector bar. The arcuate connector 720 bar also includes a mount landing having an opening. The mount landing is designed to be inserted between upper portion 780 and lower portion 782 of mount plate 770. The arcuate bar is connected to the mount plate by aligning openings 784, 786 in mounting plate 770 with the opening in the mount landing and then inserting a bolt through the holes. This connection allows the plow blade to pivot about the openings.

As shown in FIGS. 11–13, the top portion 722 of arcuate bar 720 is held in a downward position by top plate 788. Top plate 788 is mounted on mid-brace 790. Mid-brace 790 adds structural support to the A-frame. Top plate 788 allows the arcuate bar to pivot from side to side about openings 784, 786. The back end of struts 760 include cylinder brackets 792 for mounting a cylinder 798 in bracket openings 794 by a bracket bolt 796. The other end of cylinder 798 is secured to cylinder brackets 730 that are connected to leg portions 724 of arcuate bar 720. The cylinders, which are mounted on each side of the A-frame, permit angling of the plow blade 710 about openings 784, 786.

Arcuate bar 720 is connected to plow blade 710 to allow the plow blade to also rotate in a forward and backward direction. Arcuate bar 720 includes two trunnions 732 connected to each leg portion 724. Each trunnion 732 has a trunion opening 734. Plow blade 710 also includes two trunions 736 secured to the structural frame 712 and/or curved braces 738. Trunnions 732, 736 provide for the mounting of spring 740 which maintains the plow blade in an upward position. When scraper blade 714 engages an obstacle in the roadway, plow blade 710 pivots about arcuate bar 720 against the action of the springs 740 which return the plow blade to its normal position after passing over the obstacle. The tension of springs 740 is adjusted to a conventional manner by adjustable arms threaded to trunnion 736.

Referring again to FIGS. 11–13, structural frame 712 is a conventional frame and comprising a longitudinally extending to mounting member 742 which extends the length of the snowplow, a longitudinally extending bottom mounting member 744 which similarly extends the length of the plow blade, and a plurality of transversely spaced inwardly curved braces 738 which extend between and are secured to the top and bottom mounting members 742, 744. Both mounting members 742 and 744 include mounting holes to enable the mounting members to be secured by mount bolts 746.

Scraper blade 714 has a bottom edge which is designed to contact the roadway for picking up snow in a known manner and is secured to curve braces 744 and/or a bottom mounting member by a scraper bracket. Scraper blade 44 extends on the complete longitudinal length of the bottom edge of the snowplow blade.

Attached to the top edge of plow blade 710 is a deflector flap 800. Deflector flap 800 is secured to flap bracket 802 which in turn is secured to the top edge of plow blade 710. Flap bracket 802 includes bracket openings 804 to allow bracket bolts 806 to secure the deflector flap 800 to the flap bracket and to secure flap bracket 802 to the top edge of plow blade 710. Deflector flap 800 extends downwardly from the top edge of plow blade 710 and functions as a barrier to snow and other debris which are traveling along the upper inner surface of snowplow blade 710 during snowplow operation and prevents such snow and debris from being propelled from snowplow blade 710 at high velocities.

Figure 17:
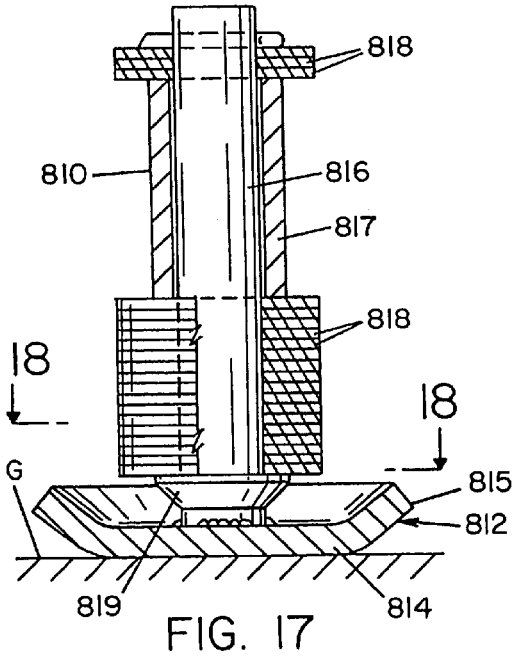
FIG. 17 is a further enlarged cross-sectional view taken along lines 17—17 in FIG. 12.
Figure 18:
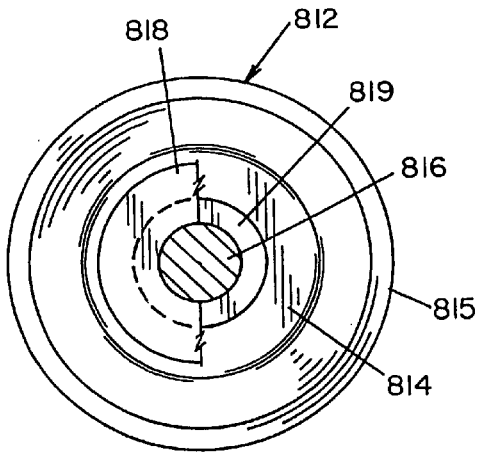
FIG. 18 is a cross-sectional view taken along lines 18—18 in FIG. 17.

As shown in FIGS. 11–13, 17 and 18, secured to the bottom mounting member 744 is a skid bracket 810 for adjustably receiving a skid plate 812. Skid plate 812 includes a circular base plate 814 designed to contact ground surface G during the operation of the snowplow. Base plate edge 815 is angled upwardly to facilitate the movement of base plate along this ground surface. Skid plate 812 includes a rod 816 secured to base plate 814 and which secures to skid bracket 810. Washers 818 are used to adjust the height of skid plate 812. The washers 818 include a central opening to fit around 816. A sleeve 817 is also positioned around rod 816 and defines the lowest position of the skid plate. As shown in FIG. 17, washers are positioned between sleeve 817 and skid bracket 810. Washers 818 are also positioned between sleeve 817 and plate flange 819. Washers are added or subtracted from rod 816 to adjust the height of the skid plate.

Figure 14:
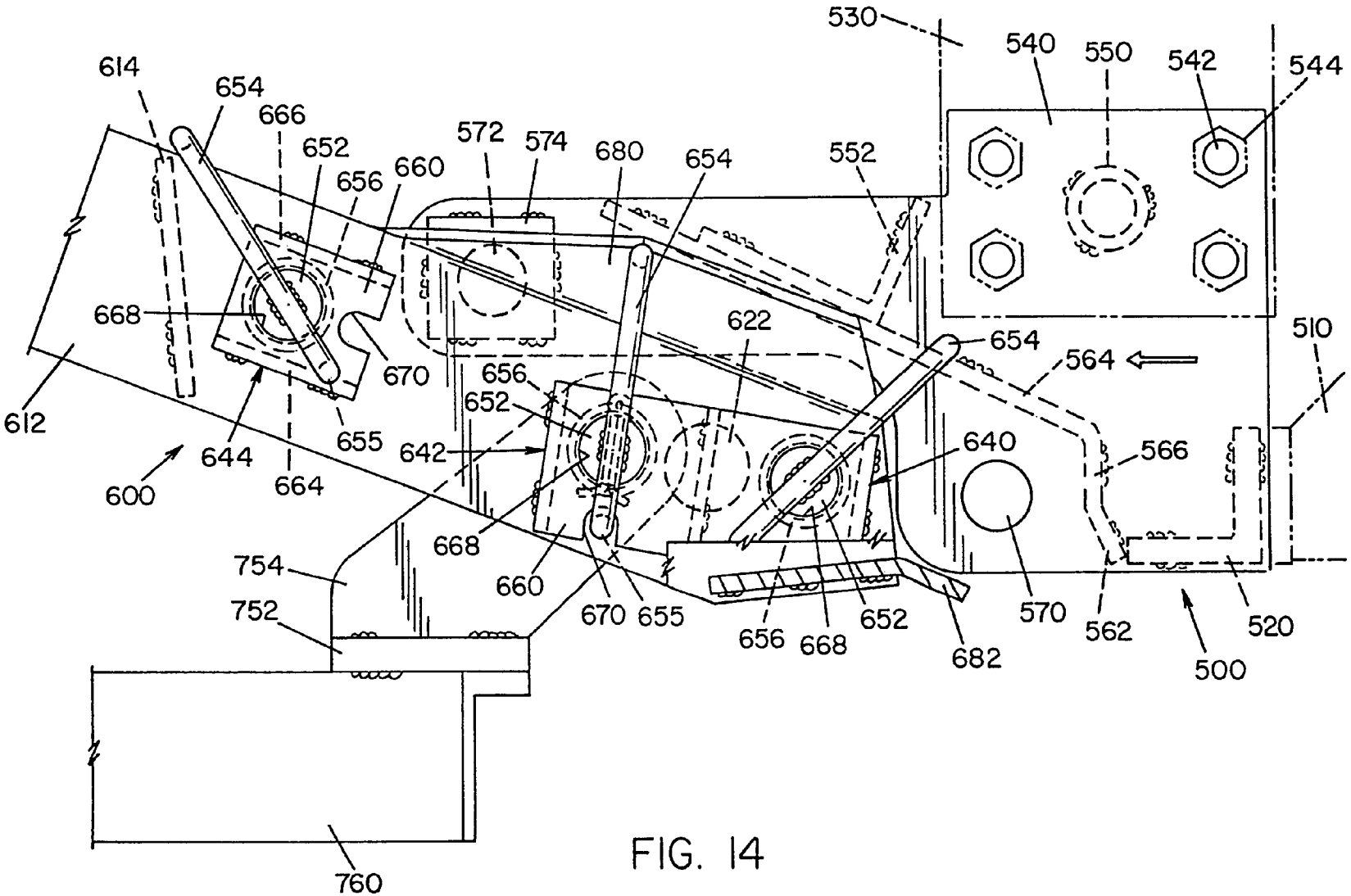
FIG. 14 is a fragmentary elevational enlarged view of the frame mount assembly as illustrated in FIG. 11 wherein the frame mount assembly is secured to the support assembly.

Referring now to FIGS. 11–13 and 20, a stand 850 can be connected to the A-frame. A stand flange 860 is secured to the bottom side of one of the struts 760 The end 862 of stand flange 860 includes a cylindrical section 864 and an adbutment section 866. The cylindrical section includes several openings 868. Stand 850 includes a bottom leg 870 having a base plate 872. Bottom leg 870 is partially received in stand cylinder 874 and moves therein. A crank mechanism 876 is secured to the top of cylinder 874. The crank mechanism is designed to move bottom leg into and out of cylinder 874 to adjust the height of the stand. A crank arm 878 having a handle 880 is secured to the crank mechanism. The crank mechanism can use a variety of arrangements to move the bottom leg. One type of arrangement is a screw drive. A connection flange 890 is secured to the outer surface of cylindrical section 864. The connection flange includes a cylindrical end 892 having a circular opening which is designed to receive cylindrical section 864 of stand flange 860 when stand is to be mounted on the A-frame. A pin 894 secured to connection flange 890 by chain 896 is inserted through opening 898 in cylindrical end 892 and through aligned openings 868 of cylindrical section 864 to secure stand 850 to the A-frame 750. As shown in FIGS. 13 and 14. When stand 850 is not in use, stand 850 is stored on support assembly 600 and/on lift mount assembly 900 as illustrated in FIG. 11.

Referring now to FIGS. 11–16, frame mount assembly 500 is shown as being secured to the underside of the vehicle. As shown in FIGS. 11–13, two support struts 510 are attached at one end to the vehicle frame members 452 and the other end of support strut is secured to bracket plate 520 and is secured by bolts secured within plate opening 522. The frame mount assembly also includes a frame plate 530 which is secured by plate bolts 532 to frame members 452. The frame plate and support struts rigidly secure mounting bracket 540 via bolts 544 in openings 542 to the frame members and rearwardly of the bumper.

Figure 16:
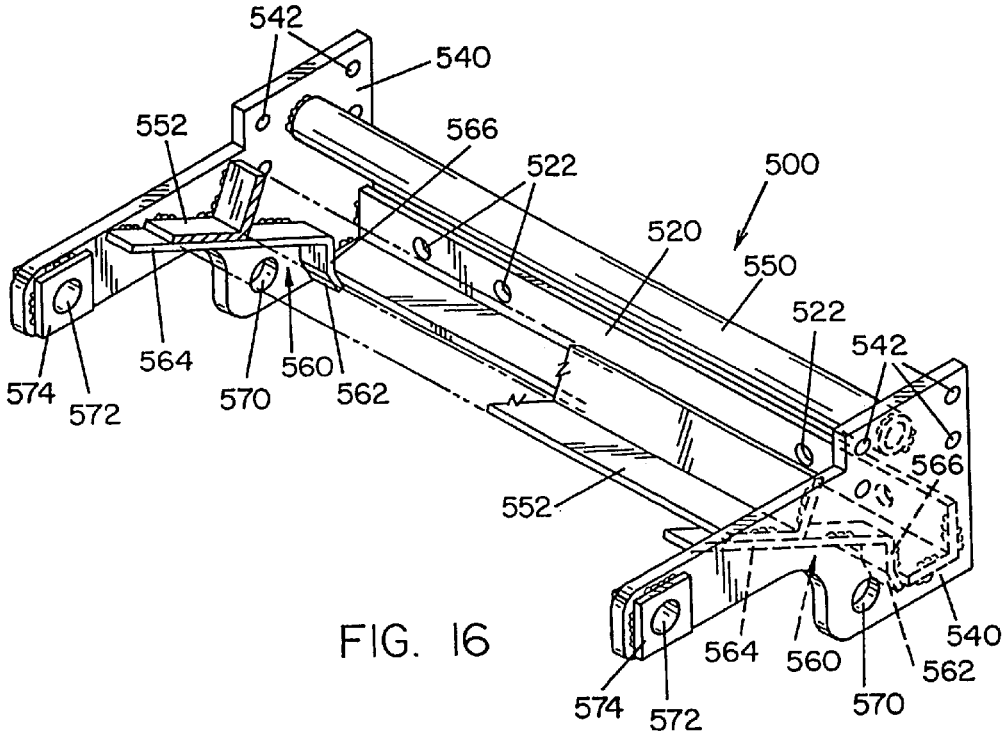
FIG. 16 is a detached front perspective view of the frame mount assembly in FIG. 11.

Referring specifically to FIG. 16, the two mounting brackets 540 are secured together by bracket brace 550, arm bracket 552, and bracket plate 520. These three structures maintain the rigidity of the mounting brackets while supporting the other members of the snowplow mount assembly. Formed under arm bracket 552 and bracket plate 520 is a connection region 560. Connection region 560 is designed to receive a portion of the support assembly. Connection region 560 includes a lower lip 562 which angles downwardly. Connection region 560 also includes an arm 564 which extends from a wall surface 566 angles upwardly from this wall surface. Arm 564 is supported in position by arm bracket 552. Both arm bracket 552 and bracket plate 520 have an L-shaped configuration to provide additional rigidity to the frame mount assembly. Preferably, bracket brace 550, arm 564, wall 566, arm bracket 552, and bracket plate 520 are welded to the inner surface of the two mounting brackets 540. Mounting bracket 540 also includes support openings 570 and 572. Support opening 570 is designed to align with an opening in a portion of the support assembly to thereby secure the support assembly to connection region 560. Support opening 572 is designed to align with another opening in the support assembly to rigidly secure the support assembly to the frame mount assembly. Support opening 572 includes opening supports 574 on both sides of the opening to reinforce the opening and reduce the amount of wear within the opening.

Figure 15:
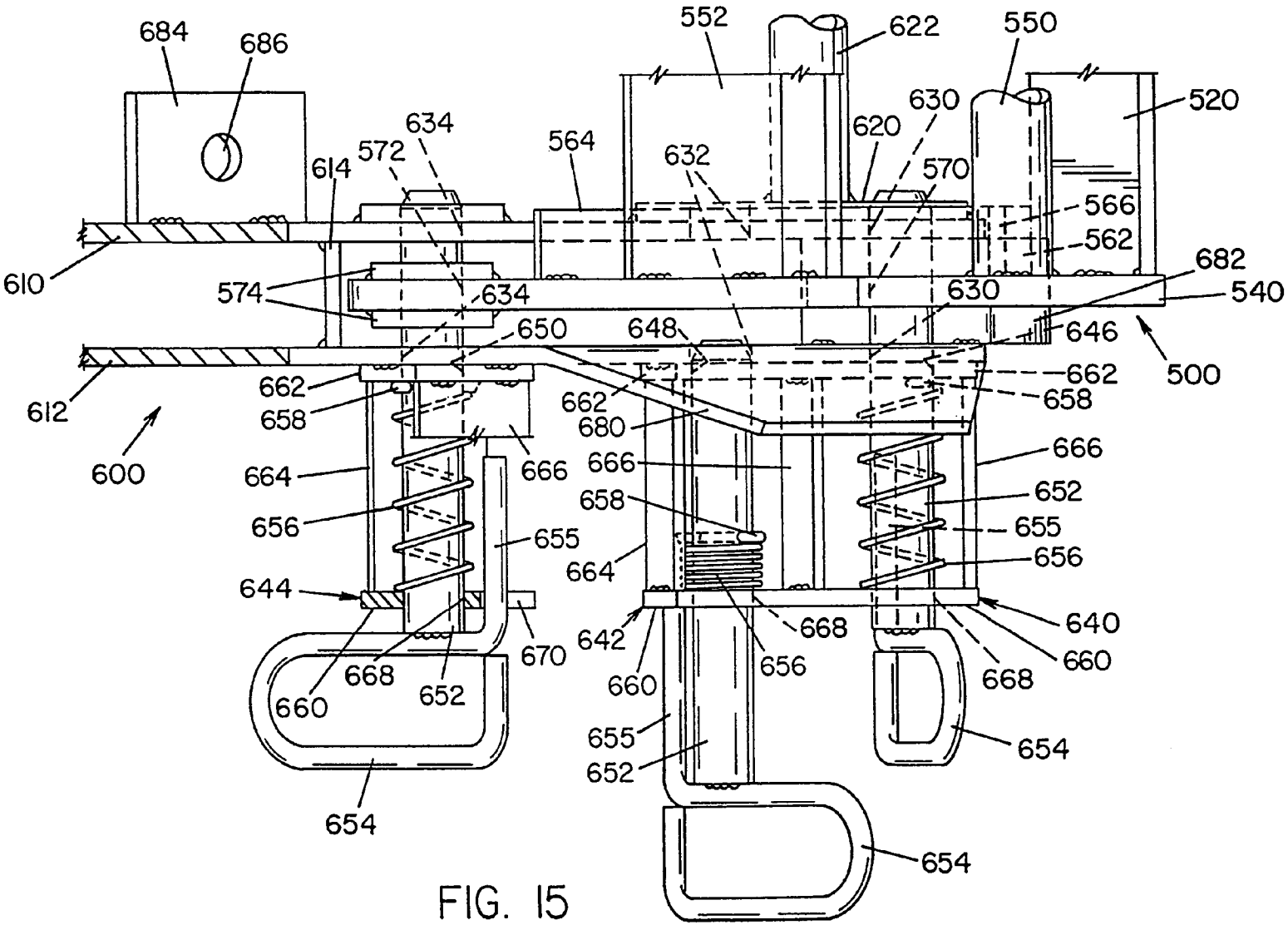
FIG. 15 is a cross-sectional view taken along lines 15—15 in FIG. 12.

Referring to FIGS. 11–13 and 19, support assembly 600 includes a pair of inner legs 610 and a pair of outer legs 612. The inner legs and outer legs are laterally spaced apart. A leg brace 614 secures each pair of inner and outer legs together. A leg flange 620 is secured to the inner side of each of the inner legs which in turn is connected to a leg bar 622. Leg flange 620 is welded to the inner side of the leg and leg bar 622 is preferably welded to the inner side of leg flange 620. Inner legs and outer legs include a plurality of openings for securing the support assembly to the frame mount assembly and to connect other components of the snowplow mount assembly to the support assembly. At one end of the inner leg and outer leg is a landing opening 630. Spaced from landing opening 630 is journal opening 632. Spaced from journal opening 632 is an upper support opening 634. Connected to the exterior side of outer leg 612 is a pin housing 640, 642 and 644. Pin housing 640 includes housing opening 646 which are aligned with opening 630. Pin housing 642 includes housing opening 648 which are aligned with journal openings 632. Pin housing 644 includes housing openings 650 which are aligned with upper support openings 634. Pin housings 640, 642, and 644 are designed to maintain a pin 652 within the housing. Pin 652 includes a pin handle 654 radially extending from the end of the pin. Pin 652 is biased in a lock position by a spring 656. Pin handle 654 limits the movement of pin 652 within the pin housing. The positioning of pin 652 within the pin housing is best illustrated in FIG. 15. As shown in FIG. 15, pin 652 in housing 642 is in the retracted position and pins 652 in housings 640 and 644 are in the lock position. Pins are biased in lock position by spring 656. The pins 652 include a pin stop 658 which protrudes from the surface of the pin. Pin stop 658 limits the movement of pin 652 within housings 640, 642 and 644. Pin stop 658 also limits the positioning of spring 656 on the pin.

As best shown in FIG. 15, pin housings 640, 642, an 644 include a front face 660, and back face 662, and two side faces 664, 666. Front face 660 include two opening, a pin opening 668 and a pin head opening 670. Pin opening 668 is sized to allow pin 652 to move through the opening. Pin head opening is sized to allow a pin head leg 655 to pass through the opening. When the pin head leg 655 is in pin opening 670, pin 652 is in the locked position, and also prevents rotation of pin 652 in the housing. When pin 652 is to be moved in the retracted or unlocked position, pin head leg 655 is retracted from pin head opening 670. The pin can be maintained in the unlocked position by rotating pin 652 until pin head leg 655 is not aligned with pin head opening 670. When the pin is in the unlocked position, spring 656 is in a compressed position. When the pin is to be returned to the locked position, pin 652 is rotated until pin head leg 655 realigns with pin head opening 670 and then inserted through the opening. Pin handles 654 facilitated in the moving of the pins between the unlocked and locked positions.

Referring again to FIG. 15, the end position of support assembly 600 includes a positioning flange 680. Positioning flange 680 is attached to outer leg 612 and angles upwardly and outwardly therefrom. Positioning flange 680 is designed to facilitate in orienting this positioning of supporting assembly 600 in frame mount assembly 500. When connecting these two assemblies together position flange 680 is specifically designed to adjust the lateral orientation of the support assembly within the frame mount assembly.

Referring now to FIGS. 11–14, support assembly includes a guide lip 682. Like positioning flange 680, guide lip 682 facilitates in orienting the supporting assembly in the frame mount assembly when the two assemblies are connected together. Guide lip 682 is specifically designed to adjust the vertical orientation of the support assembly within the frame mount assembly.

Referring to FIG. 15, support assembly 600 includes a stop flange 684 secured to inner leg 610. Stop flange 684 limits the amount of the support assembly which can be received by the frame mount assembly when connecting together the two assemblies. Stop flange 684 is designed to minimize damage to the vehicle and to components of the snowplow mount assembly. Stop flange 684 includes an opening 686 which can receive a rubber tap or the like.

As shown in FIGS. 11–13, an actuator 950 is secured to the lift mount assembly. A pair of actuator brackets 952 each having an opening 953 to pivotally secure the base of the actuator to support bar 920. The piston 954 of actuator 950 is secured to lift arm 960 within bracket openings 944 by a pin, bolt or the like secured through bracket openings 944 and mount opening 956. The end 962 of lift arm 960 includes a lift hook 964 to secure to a rope or chain 970. Chain 970 is secured to blade mount assembly by connecting the chain to lift bracket 772 on mount plate 770.

Figure 19:
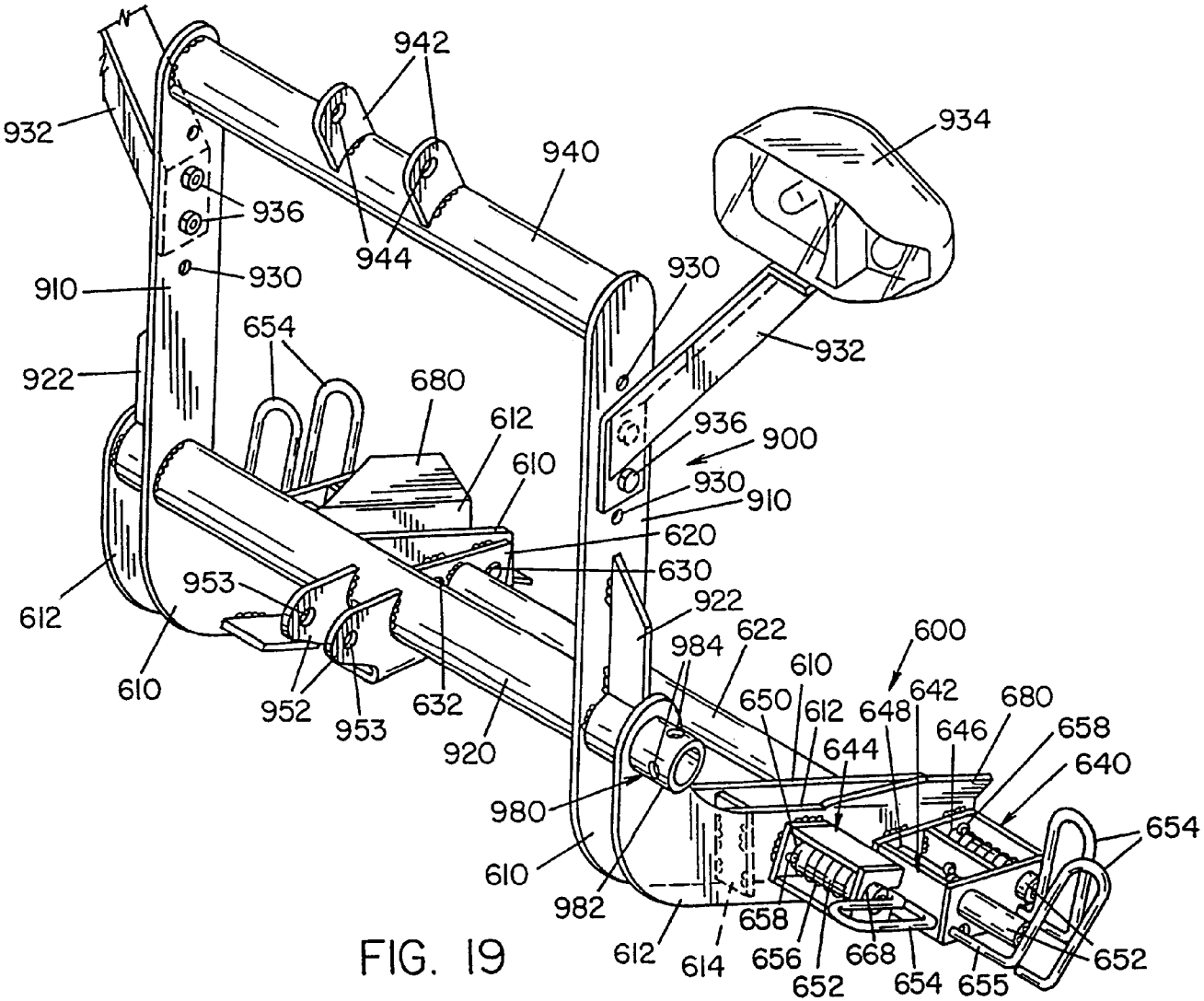
FIG. 19 is a detached front perspective view of the support assembly and lift mount assembly in FIG. 11; and, FIG. 20 is an exploded front perspective view of the plow mount assembly in FIG. 11 without the snowplow blade.

As shown in FIG. 19, a support flange 922 is secured to the outer side of lift legs 910 and is also secured to support bar 920. Support flange 922 adds support and rigidity to the lift legs.

Referring again to FIG. 19, each lift leg 910 includes a plurality of leg openings 930. The leg opens are designed to connect auxiliary light flanges 932 to the lift legs 910. The auxiliary light flanges 932 connect auxiliary lights 934 to the lift mount assembly. The plurality of leg openings 930 enable the height of the auxiliary lights 934 to be adjusted for various types of vehicles. The auxiliary light flanges are secured to lift legs 910 by bolts 936. Secured between lift legs 910 is a lift bar 940. Lift bar 940 includes a pair of bar brackets 942 laterally spaced from one another. Each of the bar brackets has a bracket opening 944. The lift bar can be designed to be secure in a single or a plurality of positions about the longitudinal axis of the lift bar. If the lift bar is securable in a plurality of positions, the lift bar is then designed to be connected to one or more of the openings 930.

As shown in FIGS. 11–13, an actuator 950 is secured to the lift mount assembly. A pair of acuator brackets 952 having opening 953 pivotly secure the base of the acuator to support bar 920. The piston 954 of acuator 950 is secured to lift arm 960 within bracket openings 944 by a pin, bolt or the like secured through bracket openings 944 and mount opening 956. The end 962 of lift arm 960 includes a lift hook 964 to secure to a rope or chain 970. Chain 970 is secured to plow mount assembly by connecting the chain to lift bracket 772 on mount plate 770.

Referring to FIG. 19, one end of support bar 920 includes a mount bracket 980 for support stand 850. The mount bracket 980 includes a cylindrical end 982 which can be inserted into connection flange 890 of the support stand as shown in FIG. 11. This cylindrical end 982 includes openings 984 to receive pin 894 when securing the support stand for storage to the lift mount assembly.

The operation of snowplow mount assembly 400 is similar to the operation of snowplow mount assembly 20, thus will not be further described.

The invention has been described with reference to preferred and alternate embodiments. Modifications and alterations will become apparent to those skilled in the art upon reading and understanding the detailed discussion of the invention provided for herein. This invention is intended to include all such modifications and alterations insofar as they come within the scope of the present invention.

Having thus described the invention, it is claimed:

1. A snowplow blade mount assembly designed to be mountable on a vehicle, said snowplow blade mount assembly comprising a frame mount assembly, a support mount assembly, and a plow mount assembly, said frame mount assembly including a connection assembly designed to connect to a portion of a vehicle frame, said frame mount assembly is designed to be substantially non-detachably mountable to a frame at a front portion of the vehicle without connection to a front bumper of the vehicle, said frame mount assembly being mountable to the vehicle frame such that a majority of said frame mount assembly is positioned below the vehicle front bumper and that no portion of said frame mount assembly extends beyond the vehicle front bumper and that no portion of said frame mount assembly connects to or extends outwardly from outer sides of the vehicle, said support mount assembly designed to at least partially support a lift mount assembly, said lift mount assembly designed to at least partially lift at least a portion of said plow mount assembly, said plow mount assembly including a frame structure designed to be connected to a snowplow blade at one end and said support mount assembly at another end, said support mount assembly designed to be detachably connected to a connection arrangement of said frame mount assembly, a majority of said connection arrangement of said frame mount assembly designed to be positioned below the bottom level of the front bumper of the vehicle when said frame mount assembly is mounted to the vehicle, said connection arrangement of said frame mount assembly designed to fully secure said support mount assembly to said frame mount assembly, said connection arrangement of said frame mount assembly including a plurality of connectors, at least two of said connectors designed to at least partially connect said support mount assembly to said frame mount assembly, said connection arrangement of said frame mount assembly including at least one engagement arrangement designed to receive at least a part of a front portion of said support mount assembly and designed to at least partially limit movement of said support mount assembly relative to said frame mount assembly when said support mount assembly is secured by said connection arrangement of said frame mount assembly, at least one of said connectors is spaced forwardly from said engagement arrangement, said plow mount assembly including a connection arrangement designed to enable said plow mount assembly to be pivotally connectable to said support mount assembly, said plow mount assembly designed to be connectable to said support mount assembly in a manner that said plow mount assembly is spaced from and does not engage with said frame mount assembly when said support mount assembly is connected to said frame mount assembly and said plow mount assembly is connected to said support mount assembly, said connection arrangement of said plow mount assembly designed to be detachably connectable to said support mount assembly to enable said plow mount assembly to be disengaged from the vehicle without having to partially or fully disconnect said support mount assembly from said frame mount assembly.

2. The assembly as defined in claim 1, wherein said at least one engagement arrangement of said connection arrangement of said frame mount assembly is designed to at least partially telescopically receive at least a portion of said support mount assembly.

3. The assembly as defined in claim 1, wherein a portion of said at least one engagement arrangement includes an angular lip to guide at least a portion of said support mount assembly when connecting said support mount assembly to said frame mount assembly.

4. The assembly as defined in claim 2, wherein a portion of said at least one engagement arrangement includes an angular lip to guide at least a portion of said support mount assembly when connecting said support mount assembly to said frame mount assembly.

5. The assembly as defined in claim 1, wherein said connection arrangement of said frame mount assembly includes first and second connectors to at least partially secure said support mount assembly to said frame mount assembly, said first and second connectors spaced from said at least one engagement arrangement.

6. The assembly as defined in claim 4, wherein said connection arrangement of said frame mount assembly includes first and second connectors to at least partially secure said support mount assembly to said frame mount assembly, said first and second connectors spaced from said at least one engagement arrangement.

7. The assembly as defined in claim 5, wherein said first and second connectors include removable pins.

8. The assembly as defined in claim 6, wherein said first and second connectors include removable pins.

9. The assembly as defined in claim 1, including a leg support to elevate at least one end of said plow mount assembly from the ground when said plow mount assembly is separated from the vehicle.

10. The assembly as defined in claim 8, including a leg support to elevate at least one end of said plow mount assembly from the ground when said plow mount assembly is separated from the vehicle.

11. The assembly as defined in claim 9, wherein said leg support adjustably elevates said at least one end of said plow mount assembly from the ground.

12. The assembly as defined in claim 11, wherein said leg support is positionable between a retracted non-supporting position and an extended supporting position.

13. The assembly as defined in claim 1, wherein said lift mount assembly includes a connector that detachably connects to said plow mount assembly.

14. The assembly as defined in claim 10, wherein said lift mount assembly includes a connector that detachably connects to said plow mount assembly.

15. The assembly as defined in claim 1, wherein said lift mount assembly is permanently rigidly connected to said support mount assembly.

16. The assembly as defined in claim 1, wherein said lift mount assembly includes first and second extension legs, said legs including a plurality of connector positions to adjustably position the height of a lift bar connected to said legs.

17. The assembly as defined in claim 14, wherein said lift mount assembly includes at least one auxiliary light connector designed to connect an auxiliary light to said lift mount assembly.

18. The assembly as defined in claim 1, including at least one auxiliary light connector designed to connect an auxiliary light to said lift mount assembly.

19. The assembly as defined in claim 1, wherein said snowplow blade includes a flexible deflector flap secured to a top edge of said plow blade and extending downwardly from said top edge.

20. The assembly as defined in claim 17, wherein said snowplow blade includes a flexible deflector flap secured to a top edge of said plow blade and extending downwardly from said top edge.

21. The assembly as defined in claim 1, wherein said plow mount assembly includes a skid plate designed to contact a ground surface when plowing snow from the ground surface, said skid plate adjustably extendable toward said ground surface.

22. The assembly as defined in claim 20, wherein said plow mount assembly includes a skid plate designed to contact a ground surface when plowing snow from the ground surface, said skid plate adjustably extendable toward said ground surface.

23. A snowplow blade mount assembly designed to be mountable on a vehicle, said snowplow blade mount assembly comprising a frame mount assembly including a connection assembly and a connection arrangement, a support mount assembly including a connection end, and a plow mount assembly including a frame structure, said frame structure of said plow mount assembly designed to be connectable to said support mount assembly at a support connection end of said frame structure and connectable to a snowplow blade at a plow connection end of said frame structure, said support mount assembly designed to at least partially support a lift mount assembly, said lift structure designed to at least partially lift said plow mount assembly, said frame mount assembly including a connection assembly designed to connect to a portion of a vehicle frame, said frame mount assembly designed to be substantially non-detachably mountable to a vehicle frame at a front portion of the vehicle, said frame mount assembly designed to be mountable to the vehicle frame such that a majority of said frame mount assembly is positioned below a vehicle front bumper and that no portion of said frame mount assembly extends beyond the vehicle front bumper and that no portion of said frame mount assembly connects to or extends outwardly from outer sides of the vehicle, said connection end at a front portion of said support mount assembly designed to be detachably connectable to the connection arrangement of said frame mount assembly, a majority of said connection arrangement of said frame mount assembly positioned below the bottom level of the vehicle front bumper, said connection arrangement designed to fully secure said support mount assembly to said frame mount assembly, said connection arrangement of said frame mount assembly including at least one engagement arrangement and a plurality of connectors positioned forwardly of the at least one engagement arrangement, at least two of said connectors designed to at least partially connect said support mount assembly to said frame mount assembly, said at least one engagement arrangement designed to receive at least a part of said front portion of said support mount assembly and to at least partially limit movement of said support mount assembly relative to said frame mount assembly when said support mount assembly is secured to said frame mount assembly by said connection arrangement, said support mount assembly or said plow mount assembly including a leg support designed to elevate at least a portion of said plow mount assembly from a ground surface when said support mount assembly is detached from said connection arrangement of said frame mount assembly or said plow mount assembly is disconnected from said support mount assembly, said support connection end of said plow mount assembly designed to be pivotally connectable to said support mount assembly, said plow mount assembly designed to be detachably connectable to said support mount assembly to enable said plow mount assembly to be disengaged from the vehicle without having to partially or fully disconnect said support mount assembly from said frame mount assembly.

24. The assembly as defined in claim 23, wherein said leg support adjustably elevates at least a portion of said plow mount assembly from the ground.

25. The assembly as defined in claim 24, wherein said leg support is positionable between a retracted non-supporting position and an extended supporting position.

26. The assembly as defined in claim 23, wherein said plurality of connectors each include at least one removable pin.

27. The assembly as defined in claim 25, wherein said plurality of connectors each include at least one removable pin.

28. The assembly as defined in claim 26, wherein at least one of said removable pins is secured in position by a removable pin clip.

29. The assembly as defined in claim 27, wherein at least one of said removable pins is secured in position by a removable pin clip.

30. The assembly as defined in claim 23, wherein said support connection end of said plow mount assembly is designed to be detachably connectable to said support mount assembly by at least one removable pin.

31. The assembly as defined in claim 29, wherein said support connection end of said plow mount assembly is designed to be detachably connectable to said support mount assembly by at least one removable pin.

32. The assembly as defined in claim 30, wherein at least one of said removable pins is secured in position by a removable pin clip.

33. The assembly as defined in claim 31, wherein at least one of said removable pins is secured in position by a removable pin clip.

34. The assembly as defined in claim 23, wherein said connection arrangement of said frame mount assembly includes at least two engagement arrangements, each of said engagement arrangements is designed to at least partially telescopically receive at least a portion of said support mount assembly.

35. The assembly as defined in claim 33, wherein said connection arrangement of said frame mount assembly includes at least two engagement arrangements, each of said engagement arrangements is designed to at least partially telescopically receive at least a portion of said support mount assembly.

36. The assembly as defined in claim 28, wherein said connection arrangement of said frame mount assembly includes at least two engagement arrangements, each of said engagement arrangements is designed to at least partially telescopically receive at least a portion of said support mount assembly.

37. The assembly as defined in claim 23, wherein said lift mount assembly is designed to be detachably connectable to said plow mount assembly.

38. The assembly as defined in claim 33, wherein said lift mount assembly is designed to be detachably connectable to said plow mount assembly.

39. The assembly as defined in claim 23, including at least one auxiliary light connector designed to connect an auxiliary light to said lift mount assembly.

40. The assembly as defined in claim 23, wherein said snowplow blade is detachably connected to said plow connection end of said plow mount assembly.

41. The assembly as defined in claim 35, wherein said lift mount assembly is designed to be detachably connectable to said plow mount assembly.

42. The assembly as defined in claim 38, including at least one auxiliary light connector designed to connect an auxiliary light to said lift mount assembly.

43. The assembly as defined in claim 42, wherein said snowplow blade is designed to be detachably connectable to said plow connection end of said plow mount assembly.

44. The assembly as defined in claim 23, wherein said plow mount assembly is designed to be spaced from and to not engage with said frame assembly when said support mount assembly is pivotally connected to said frame mount assembly and said plow mount assembly is connected to said support mount assembly.

45. The assembly as defined in claim 23, wherein said plow mount assembly is designed to be spaced from and to not engage with said frame assembly when said support mount assembly is pivotally connected to said frame mount assembly and said plow mount assembly is connected to said support mount assembly.

* * * * *

UNITED STATES PATENT AND TRADEMARK OFFICE

CERTIFICATE OF CORRECTION

PATENT NO. : 7,117,617 B2
APPLICATION NO. : 10/607906
DATED : October 10, 2006
INVENTOR(S) : James A. Kost and Robert L. Potak It is certified that error appears in the above-identified patent and that said Letters Patent is hereby corrected as shown below:

Title page, item [73]
Read "Steuberville, OH" it should read --Steubenville, OH--

Signed and Sealed this

Second Day of January, 2007

JON W. DUDAS
*Director of the United States Patent and Trademark Office*